US007954184B2

(12) United States Patent
Polevoy et al.

(10) Patent No.: US 7,954,184 B2
(45) **Date of Patent: *Jun. 7, 2011**

(54) STRUCTURAL MEMBERS FOR BED FRAME

(75) Inventors: Richard S. Polevoy, Teaneck, NJ (US); Paul E. Carlson, Skaneateles, NY (US); Howard Scott Ryan, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 115 days.

This patent is subject to a terminal disclaimer.

(21) Appl. No.: 12/229,723

(22) Filed: Aug. 25, 2008

(65) Prior Publication Data

US 2009/0300840 A1 Dec. 10, 2009

Related U.S. Application Data

(63) Continuation-in-part of application No. 11/716,951, filed on Mar. 12, 2007, now Pat. No. 7,665,163.

(60) Provisional application No. 60/965,983, filed on Aug. 23, 2007.

(51) Int. Cl.
*A47C 19/02* (2006.01)

(52) U.S. Cl. ..... 5/200.1; 2/207; 2/132

(58) Field of Classification Search ..... 72/181, 72/188, 225; 5/200.1, 201–208, 310, 286, 5/288, 296, 905, 131, 132, 238; 428/598, 428/603, 604; 238/58, 130

See application file for complete search history.

(56) References Cited

U.S. PATENT DOCUMENTS

| | | | | | |
|---|---|---|---|---|---|
| 984,823 | A * | 2/1911 | Linden | 5/279.1 |
| 1,892,427 | A * | 12/1932 | Featherman | 5/286 |
| 2,908,918 | A * | 10/1959 | Hopkes, Jr. | 5/200.1 |
| 2,997,141 | A * | 8/1961 | Wetzler | 52/836 |
| 3,056,974 | A * | 10/1962 | McKay | 5/247 |
| 3,076,979 | A * | 2/1963 | Hopkes, Jr. | 5/246 |
| 3,761,971 | A * | 10/1973 | Behnke | 5/201 |
| 3,914,810 | A * | 10/1975 | Harris | 5/286 |
| 3,995,334 | A * | 12/1976 | Harris | 5/202 |
| 4,016,612 | A * | 4/1977 | Barile, Sr. | 5/200.1 |
| 4,146,940 | A * | 4/1979 | Fredman et al. | 5/9.1 |
| RE31,384 | E * | 9/1983 | Mis | 5/202 |
| 4,947,298 | A * | 8/1990 | Stephen | 362/130 |
| 5,996,145 | A * | 12/1999 | Taylor | 5/200.1 |
| 6,234,642 | B1 * | 5/2001 | Bokamper | 362/130 |
| 6,338,172 | B1 * | 1/2002 | Taylor et al. | 5/200.1 |
| 6,397,412 | B1 * | 6/2002 | Quintile | 5/200.1 |
| 6,463,651 | B1 * | 10/2002 | Koeneker et al. | 29/513 |
| 6,711,765 | B1 * | 3/2004 | Mitchell et al. | 5/202 |
| 7,363,664 | B2 * | 4/2008 | Polevoy et al. | 5/200.1 |

* cited by examiner

*Primary Examiner* — Michael Trettel
(74) *Attorney, Agent, or Firm* — Klauber & Jackson LLC

(57) ABSTRACT

A bed frame comprising T-shaped side rails provides support for a box spring and mattress. The T-shaped side rails provide more resistance to twisting and bowing and enables the overall bed frame to support more weight with less deflection than the convention L-shaped side rails. The T-shaped side rails may be two L-shaped angle irons affixed together or a unitary T-shaped member that can also be used for other structural components of the bed frame such as a center beam. The vertical flange of the T-shape can be non-linear. In a further embodiment, the side rails are comprised of a metal skin enclosing a hollow area with a horizontal, flat shelf for supporting the box spring and a contiguous vertical surface generally at a right angle to the horizontal shelf to retain the box spring in it desired position.

25 Claims, 31 Drawing Sheets

STRUCTURAL MEMBERS FOR BED FRAME

REFERENCE TO RELATED CASES

The present patent application is based upon and hereby claims priority to Provisional Patent Application 60/965,983 filed Aug. 23, 2007 entitled "Structural Members For Bed Frame" and also is a Continuation-In-Part of U.S. patent application Ser. No. 11/716,951, filed Mar. 12, 2007 now U.S. Pat. No. 7,665,163 and entitled "T-Shaped Side Rails For Bed Frame".

BACKGROUND OF THE INVENTION

The present invention relates to bed frames, and, more particularly, to structural members that can be used in the construction of a bed frame.

In general, bed frames are comprised of a pair of side rails and a plurality of cross members that span between the side rails in order to assemble and complete the bed frame structure. The bed frame, once assembled is adapted to support a box spring and a mattress to make up the bed itself Normally, therefore, the conventional bed frame assembly is shipped and delivered unassembled for convenience and general transportation and the assembly includes two side rails that are L-shaped steel members as well as cross rail members.

One type of bed frame is the adjustable width folding frame and, in that bed frame, the cross rails are formed of cross rail members that are pivotally affixed at or near each end of the side rails. For delivery to a customer, the cross rail members are interfitted with and parallel to the side rails for ease of packing and shipment. In the assembly of the bed frame at the location of the customer, therefore, the cross rail members are pivoted about 90 degrees so as to extend generally at a right angle from the side rails and the opposite, free ends of the cross rail members are affixed together at the center area of the bed frame to form cross rails that thus span between each of the side rails. As such, when so assembled and affixed together, the bed frame assumes a generally rectangular configuration to accept the box spring and the mattress.

There is also, normally, a center beam that is positioned so as to be generally parallel to the side rails and which is located at or near the center of the bed frame in order to provide additional support to the overall structure and, of course to the box spring and mattress. The center beam is added to the bed frame to span between the cross rails in order to prevent the further relative movement between the cross rail members as well as to secure the center beam into the bed frame to finalize the task of assembling that bed frame.

Another type of typical bed frame is the fixed width drop together bed frame where the cross rails are fixed in length and there are female sockets formed at or near the ends of the side rails that accept male brackets located at the ends of the cross rails and the components simply drop together. The same drop together feature can be used to secure the center beam to the cross rails.

Conventionally, with either of the aforedescribed bed frames, the side rails are constructed of metal angle irons which are L-shaped in cross section and there are legs that extend downwardly at each corner of the bed frame from the cross rails to contact the floor in order to support the weight imposed on the bed frame by the presence of the box spring, mattress and, of course, an individual or individuals sleeping in the completed bed.

One of the difficulties, however, with the use of an L-shaped angle iron for the side rails is that the cross sectional profile of the L-shaped angle iron renders the member susceptible to a bending weakness, that is, for example, when the bed is slid along the floor, the leg supporting the side rail is dragged across the underlying floor and can cause the cross rail member and side rail to twist and be damaged since an L-shaped angle iron member is not particularly resistant to such twisting action. This is especially true when a leg gets caught in an obstruction on the floor or on loose carpet. The situation is exacerbated by the use of off-set casters on the legs since the off-set casters can transfer downward force into side to side force that causes the bed leg to twist.

In addition, there is a bending action that is created by downward force upon the inner horizontal flange of a L-shaped side rail by a cross member resting on or supported by the horizontal flange of the side rail and which tends to twist the L-shape into a downward V-shape and continued force tends to try to flatten that V-shape. Basically the L-shaped side rail angle iron will twist inwardly away from the vertical flange, that is, the distal end of the horizontal flange will twist away from the vertical flange in the downward direction by the load imposed on the horizontal flange of the L-shaped angle iron. Thus, the problem with the use of an L-shaped angle iron for a side rail is not limited to the possible bending caused by a leg being twisted by encountering a snag in a carpet as the leg extending downwardly from a cross rail connected to an L-shaped side rail is moved across that carpet but also simply by the weight of the load imposed on the horizontal flange of the L-shaped side rail that tends to twist the angle iron.

Another difficulty with the use of L-shaped angle irons for the side rails is in the connection of the legs to the side rails in making up the bed frame. That connection needs to be a strong connection for the integrity of the overall bed frame, however, with L-shaped angle irons, the strength of that connection is inherently compromised.

A further difficulty with the present L-shaped side rail is that the exterior surface of a typical conventional side rail is the outside corner of the L-shaped angle iron and which present a relatively sharp edge that can easily be contacted by a person's shin or lower leg and cause harm to the person.

The typical conventional bed frame interfaces with a mattress and box spring by containing the side to side movement within the vertical flanges of the side rail and supports the weight through the horizontal flanges of the L-shaped side rails. The legs thus support the side rails off of the floor and, ideally, the legs would be positioned directly under the side rails at the intersection with the cross rails, giving maximum strength and support. For various reasons, however, it is also desirable to recess the legs under the bed frame. Therefore, the legs are typically affixed in some fashion, to the cross rails inboard of the side rails. Such arrangement gives an indirect connection to the side rails and results in a weak connection between the leg and the side rails.

It would thus be advantageous to have side rails or other bed frame members that are more resistant to twisting forces so that the bed frame maintains its integrity when a twisting force is experienced by a bed frame member for whatever reason. It would be further advantageous to have a side rail where the exterior surface is curved or non-linear to reduce the exposure of the edges.

SUMMARY OF THE INVENTION

Now, in accordance with the present invention, there is provided specially configured side rails or other structural members for a bed frame. As will be seem, the structural members herein described will be illustrated with respect to side rails, however, it will be seen that the same configurations and shapes can be used for other structural members of a bed frame, such as cross members or center beams.

In one exemplary embodiment, the side rails are specially configured to have a T-shaped cross section, generally rotated 90 degrees such that there is a vertical flange having a large surface of the T-shape facing outwardly from the interior of the bed frame and with the horizontal flange extending inwardly from about the center of the vertical flange. The box spring and mattress are supported on the upward surface of the horizontal flange. While that horizontal flange has a normally flat upper surface for supporting the box spring and mattress, the vertical flange may have a number of differing configurations, including curved or non-linear surfaces and/or having outer edge flanges.

The use of the T-shaped side rail is adaptable for use on either the folding bed frame or the drop together bed frame and in either case, there is considerably greater strength and resistance to twisting and the connection with a leg assembly greatly strengthened. The T-shaped cross section is substantially uniform along the length of the side rail and may be uniform along the full length of the side rail.

As another advantage of the T-shape side rails, there can be a better, more solid, connection, between the side rail and the various brackets that are used to affix the side rails to a headboard and/or footboard. For example, the headboard bracket and footboard bracket can be affixed to the side rails by means of fastening deices, such as rivets, that are more vertically spaced apart and which can be located both above and below the horizontal flange of the T-shaped side rail to improve the rigidity of that connection.

One form of a bed frame is where the side rails are actually supported by the footboard and headboard and, in such frame, the side rails can be provided with a pair of hooks that extend outwardly from the side rails to become affixed with pins that are transversely located in vertical slots in the headboard and footboard.

The T-shaped side rails can be either a pair of L-shaped angle irons secured together or may be a unitary, single piece of a metal material. In the case of the unitary, single piece structural member, that member can be also used for other structural members of the bed frame, such as the center beam. In an exemplary embodiment, the vertical flange of the T-shaped side rail is curved or non-linear to provide an esthetically pleasing appearance as well as present a smooth, exterior surface.

In another exemplary embodiment, the side rails are constructed in a rolled form, that is, there is an outside metal skin that encloses an inner space area and again the side rails exhibit improved resistance to twisting and other potentially damaging forces as oppose to the conventional L-shaped side rail. Common to all of these rolled forms, is the presence of a generally flat horizontal shelf or surface that supports the box spring and mattress and also there is normally a vertical surface contiguous to that horizontal shelf such that the box spring is retained in its desired position by being sandwiched between the vertical surfaces of opposite side rails.

Finally, as a still further exemplary embodiment, there is a structural member for use in constructing a bed frame that is a L-shaped cross section wherein at least one of the legs of the structural member has a curved or non-linear cross section.

Other features of the present structural members for a bed frame and bed frame become more apparent in light of the following detailed description of a preferred embodiment thereof and as illustrated in the accompanying drawings.

DETAILED DESCRIPTION OF THE INVENTION

Figure 1:
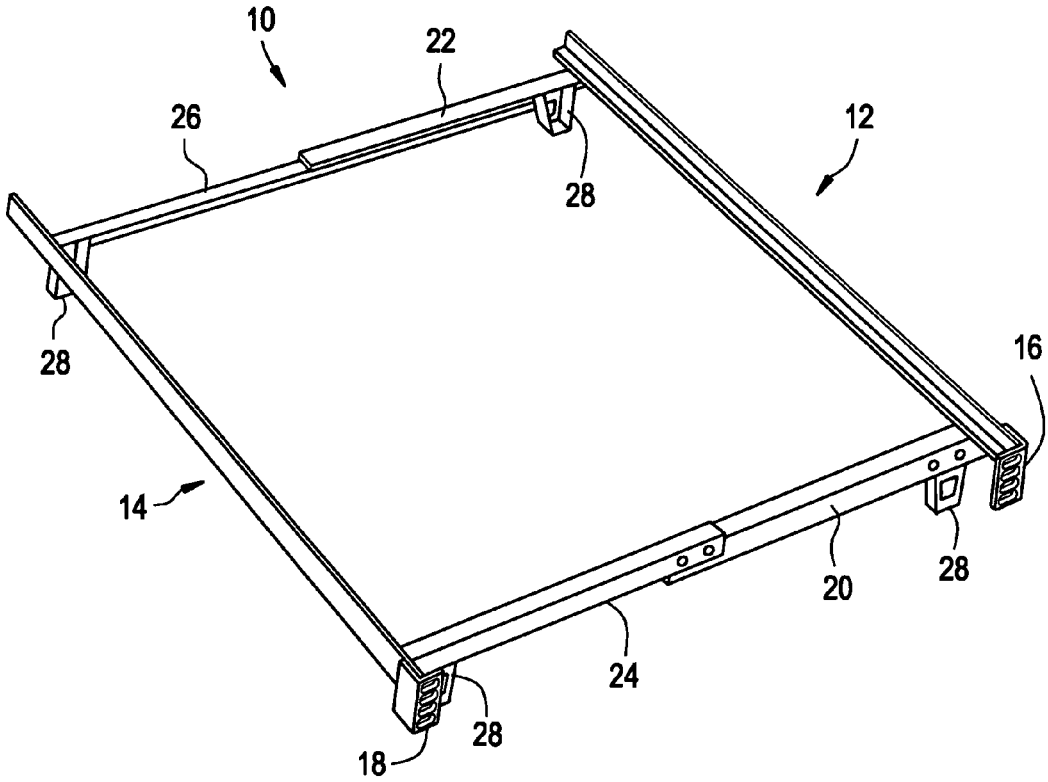
FIG. 1 is a perspective view of a conventional, prior art bed frame utilizing L-shaped side rails.

Referring now to FIG. 1, there is shown a perspective view of a conventional folding bed frame 10. In the Figure, there is a pair of side rails 12, 14 that are normally L-shaped steel members and at one end thereof, there are normally located headboard brackets 16, 18 to aid in the attachment of a headboard to the side rails 12, 14. To make up the bed frame 10, there are also cross rail members 20, 22, 24 and 26 that extend outwardly from side rails 12, 14 at about a right angle. As explained, for the convenience of handling and transportation of the components of bed frame 10, the cross rail members 20, 22, 24, 26 are pivotally mounted to the side rails 12, 14, that is, cross rail members 20 and 22 are pivotally mounted proximate to the ends of side rail 12 while cross rail members 24 and 26 are pivotally affixed proximate to the ends of side rail 14. As an example, therefore, during shipment, the cross rail members 20 and 22 are positioned 90 degrees from the orientation shown in FIG. 1 and rest parallel to and abut against the side rail 12 and, during assembly, the cross rail members 20 and 22 are rotated about 90 degrees to the position as shown.

Legs 28 extend downwardly from each of the cross rail members 20, 22, 24, 26 generally at or near the pivot point between the cross rail member and the side rails 12, 14 and the legs 28 thereby provide the support for the bed frame 10 after the assembly thereof. The legs 28 may be provided with glides or casters (not shown) that contact the floor.

Figure 2:
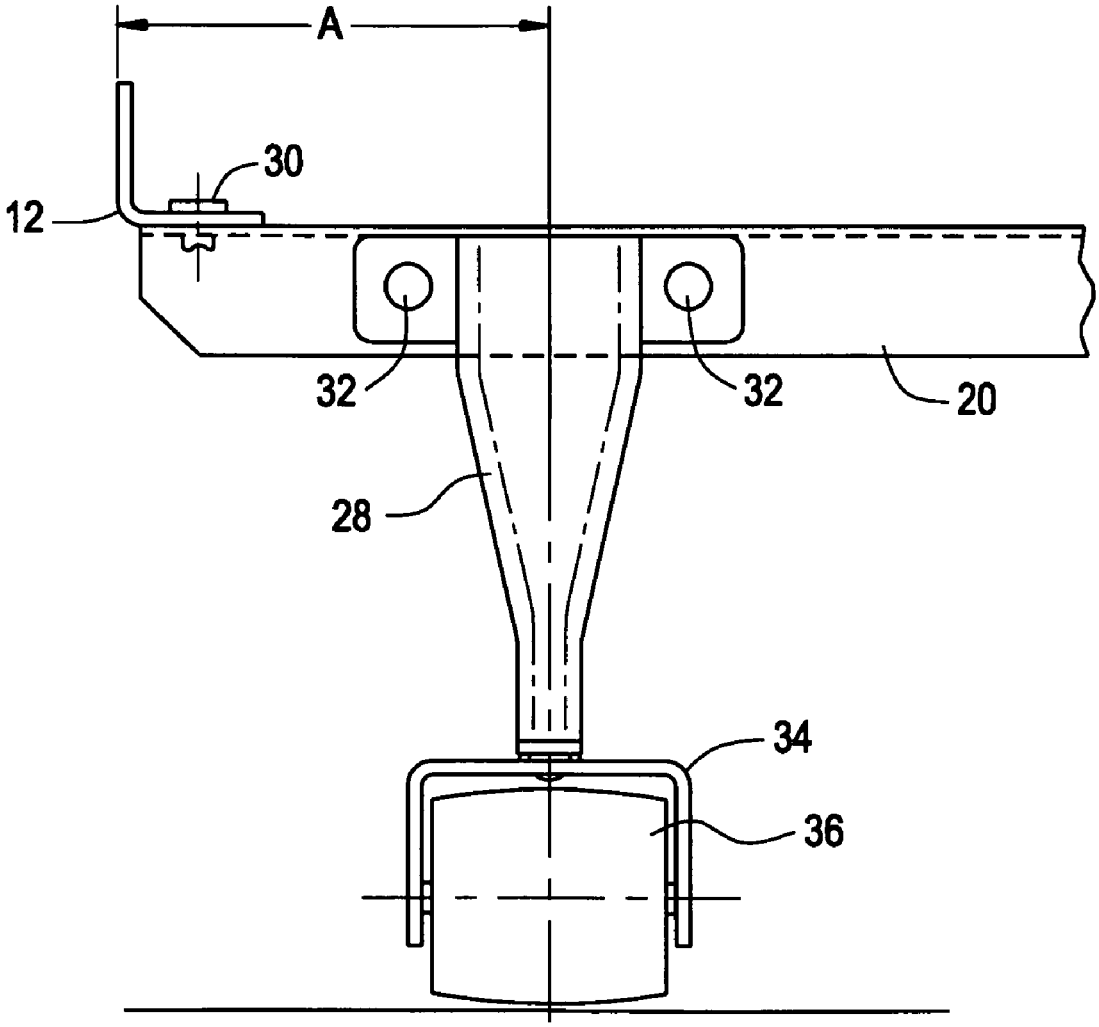
FIG. 2 is a side view of a portion of the bed frame of FIG. 1 illustrating the location of a leg affixed thereto.

Turning now to FIG. 2, there is shown a side view illustrating the location of a leg 28 to a cross rail member 20 and which is typical of the mounting of a leg to any of the other cross rail members of the folding bed frame 10 of FIG. 1. As can be seen, the L-shaped side rail 12 is affixed to the cross rail member 20 by means of a rivet 30 so that the cross rail member 20 can rotate with respect to the side rail 12 in assembling and disassembling the bed frame. The leg 28 is normally affixed to the cross rail member 28 by rivets 32 and has, at its lower end, a caster 34 including a roller 36 that contacts the floor and enables the user to wheel the bed frame 10 from one location to another. The main axis of the leg 28 is displaced away from the side rail 12 a finite distance indicated by the dimension A and that dimension or offset may be about 4.0 inches.

As indicated, ideally the leg 28 would be located directly underneath the side rail 12, however, it is desirable to recess the leg 28 under the bed to keep the leg 28 away from a hazardous location to be hit by a persons foot or ankle so the leg 28 is displaced inwardly away from the side rail 12. Unfortunately, the displacement results in an indirect connection between the leg 28 and the side rail 12 and results in a weak connection between leg 28 and side rail 12.

Figure 3:
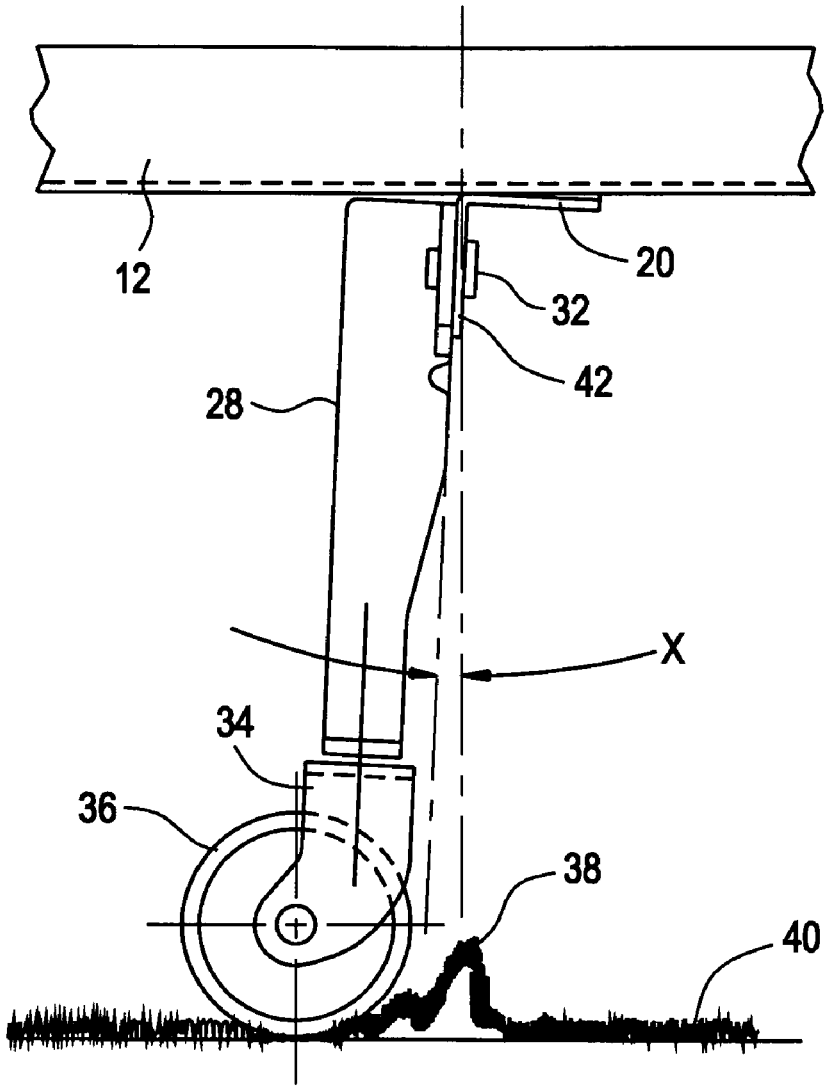
FIG. 3 is an end view of a portion of the bed frame of FIG. 2 illustrating the bending of a leg affixed thereto.

In FIG. 3, there is shown an end view of the leg 28 and which has encountered a snag 38 in a carpet 40 during the movement or rolling of the bed frame (FIG. 1) over that carpet. As such the leg 28 has been bent away from the vertical to an angle X (shown as about 3 degrees) and the vertical flange 42 of the cross rail member 20 has been bent since there is little resistance to that bending and the leg 28 as well as the cross rail member 20 can be permanently damaged.

Figure 4:
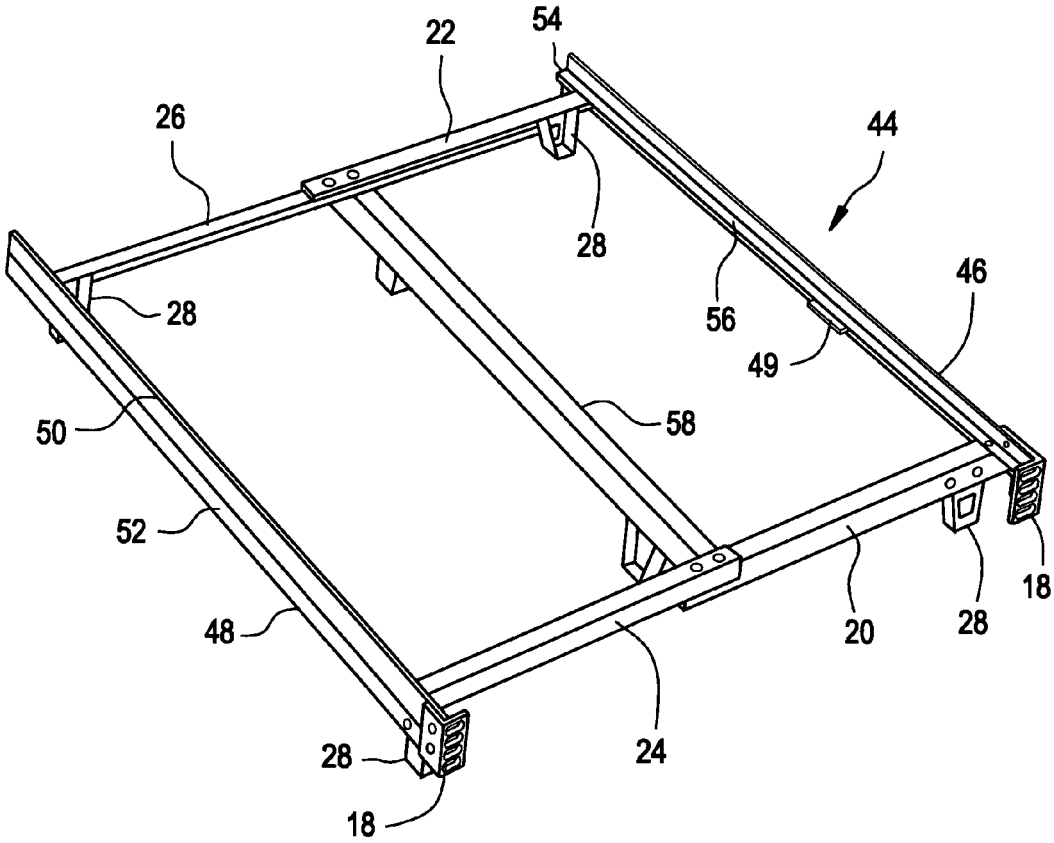
FIG. 4 is a perspective view of an adjustable width folding bed frame having side rails constructed in accordance with the present invention.

Turning now to FIG. 4, there is shown a perspective view of an adjustable width folding bed frame 44 having side rails constructed in accordance with the present invention. In the FIG., like numbers have been used for corresponding components described with respect to FIG. 1. In this embodiment, however, the side rails 46, 48 are different from the side rails 12, 14 of FIG. 1 since the side rails 46, 48 have a T-shaped cross section, rotated 90 degrees from a normal T, instead of the L-shaped cross section of FIG. 1. Thus the T-shaped side rails 46, 48 have the large flat vertical flanges 50 forming exterior surfaces 52 with horizontal flanges 54 extending inwardly from the vertical flanges 50 forming upper surfaces 56 for supporting the box spring and mattress and is located about midway between the outer edges of the vertical flanges 50.

As a further advantageous feature of the use of a T-shaped cross section for the side rails 46, 48, there can be a light producing means 49, that can be used to illuminate the area underneath the completed bed frame 44 to be used as a night light since there is no direct glare or as an aid in locating objects or cleaning underneath the bed. The position of the light producing means 49 is, as can be seen, along the inner surface of the large flat, vertical flange 50 and underneath the horizontal flange 54 so as to be protected from being struck by a passerby and thereby locating the light producing means 49 in a protective environment. The light producing means 49 can be a fluorescent light, track lighting, low voltage strip lighting, plurality of light emitting diodes or any other type of device that is capable of producing light underneath the bed frame 44 and can be used with any bed frame where T-shaped side rails are utilized.

In addition, there is also a center beam 58 that is affixed to and spans the cross rail members 20, 22, 24 and 26. Center beam 58 is generally parallel to the side rails 46, 48. That affixation of the center beam 58 to the cross rail members 20, 22, 24, and 26 may be by bolts and nuts in a conventional manner.

Figure 5:
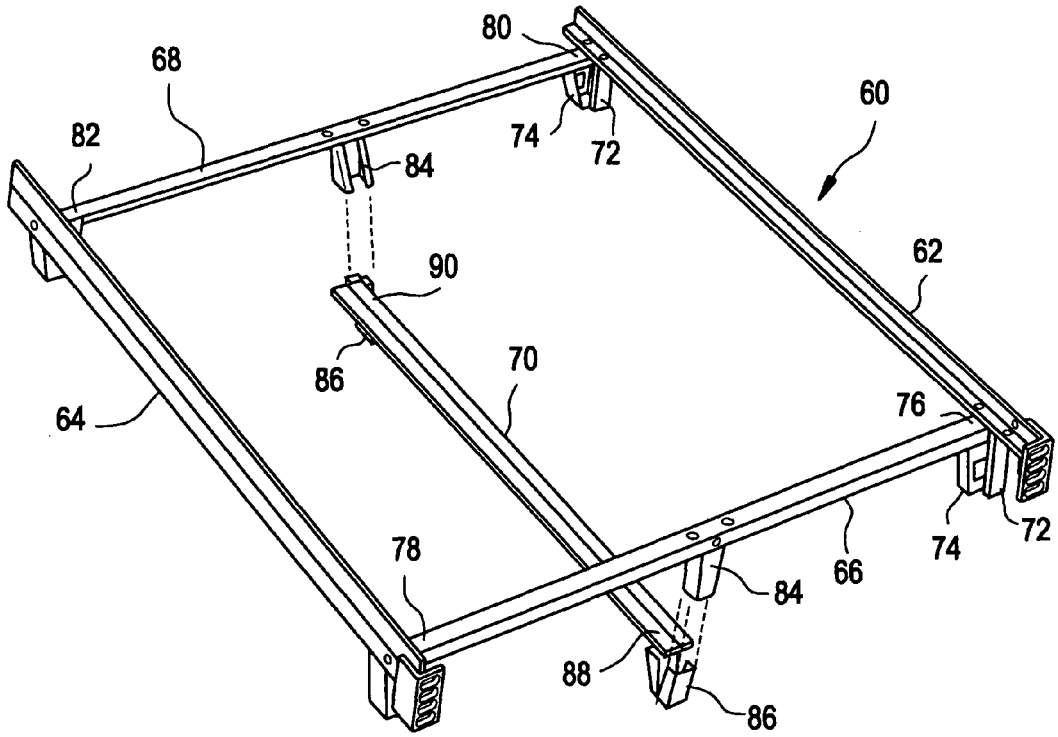
FIG. 5 is a perspective view of a fixed width drop together bed frame having side rails constructed in accordance with the present invention.

Turning now to FIG. 5, there is shown a perspective view of a fixed width drop together bed frame 60 having side rails 62, 64 constructed in accordance with the present invention. In this embodiment, the cross rails 66, 68 are of a fixed length and are affixed to the side rails 62, 64 by means such as female sockets 72 that are angled inwardly toward the interior of the drop together bed frame 60 and which receive correspondingly shaped male flanges 74 located at opposite ends 76, 78 of the cross rail 66 and opposite ends 80, 82 of the cross rail 68. In a similar manner, the center beam 70 is affixed to the cross rails 66, 68 by means of a tapered female sockets 84 that are angled inwardly toward the interior of the drop together bed frame 60 and which receive correspondingly shaped male flanges 86 located at opposite ends 88, 90 of the center beam 70. Thus, as can be seen, the drop together bed frame 60 has the side rails 62, 64 drop into the cross rails 66, 68 and the cross rails 66, 68 drop into the center beam 70 in the assembly of the drop together bed frame 60.

Figure 6:
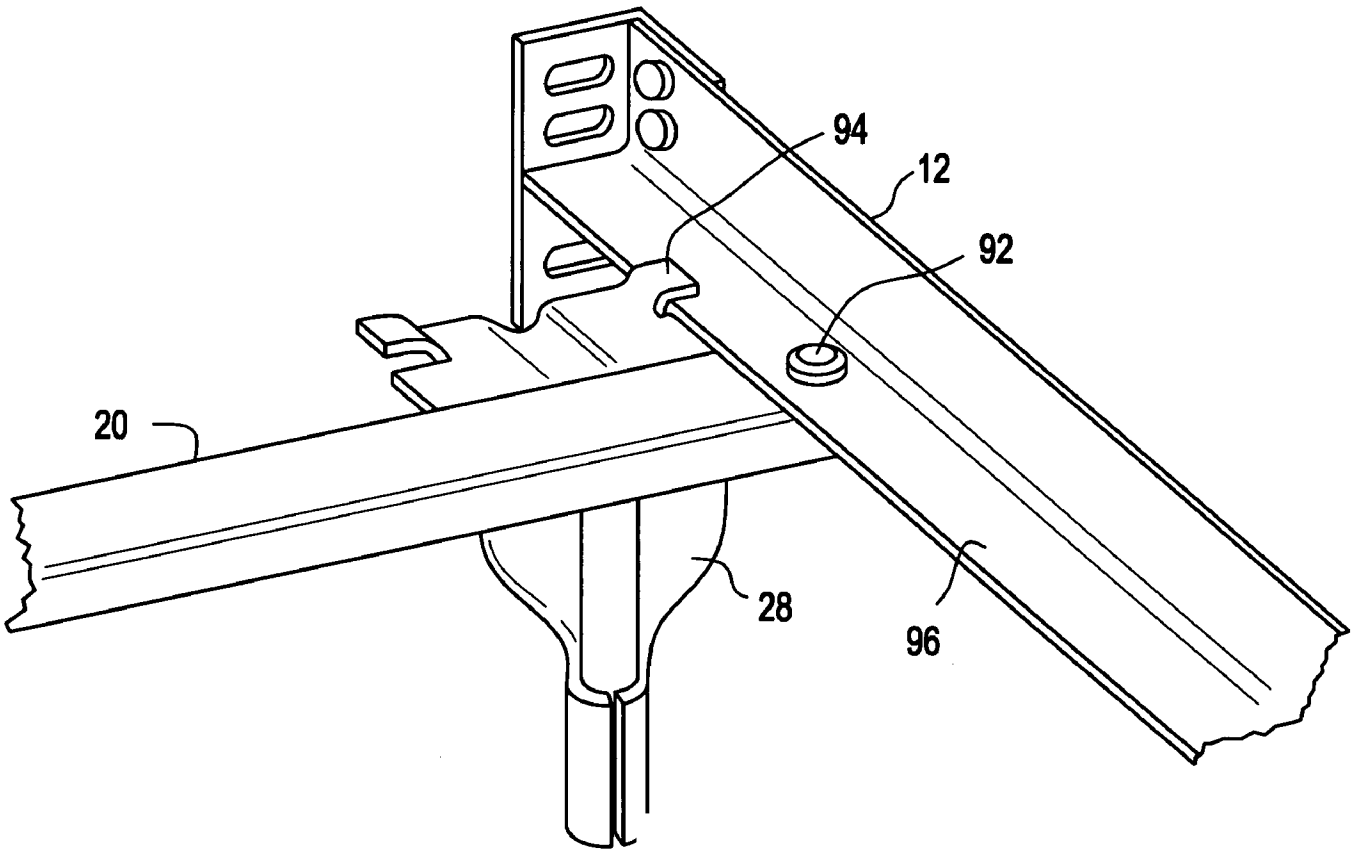
FIG. 6 is a perspective view of a junction of a side rail and a cross rail member of the conventional bed frame of FIG. 1.

In FIG. 6 there is shown a perspective view of a junction of a side rail 12 and a cross rail member 20 of the conventional bed frame 10 shown in FIG. 1. As can be seen, as the cross rail member 20 is rotated to its assembled position as shown in FIG. 6, the cross rail member 20 pivots about the rivet 92 to the point where a tab 94 formed in the leg 28 captures the lower horizontal flange 96 of the L-shaped side rail 12 within the tab 94, thereby holding the cross rail member 20 in its desired position. Such connection does not support the leg 28 in all directions of movement. As can be seen, one of the inherent weaknesses is that the two points of connection between the leg 28 and the side rail 12 are in the same plane, that is, the tab 94 connection to the lower horizontal flange 96 is located in about the same vertical plane as the connection carried out by the rivet 92 and therefore achieve no leverage advantage than if the two junction points were to be separated by a finite vertical distance.

Figure 7:
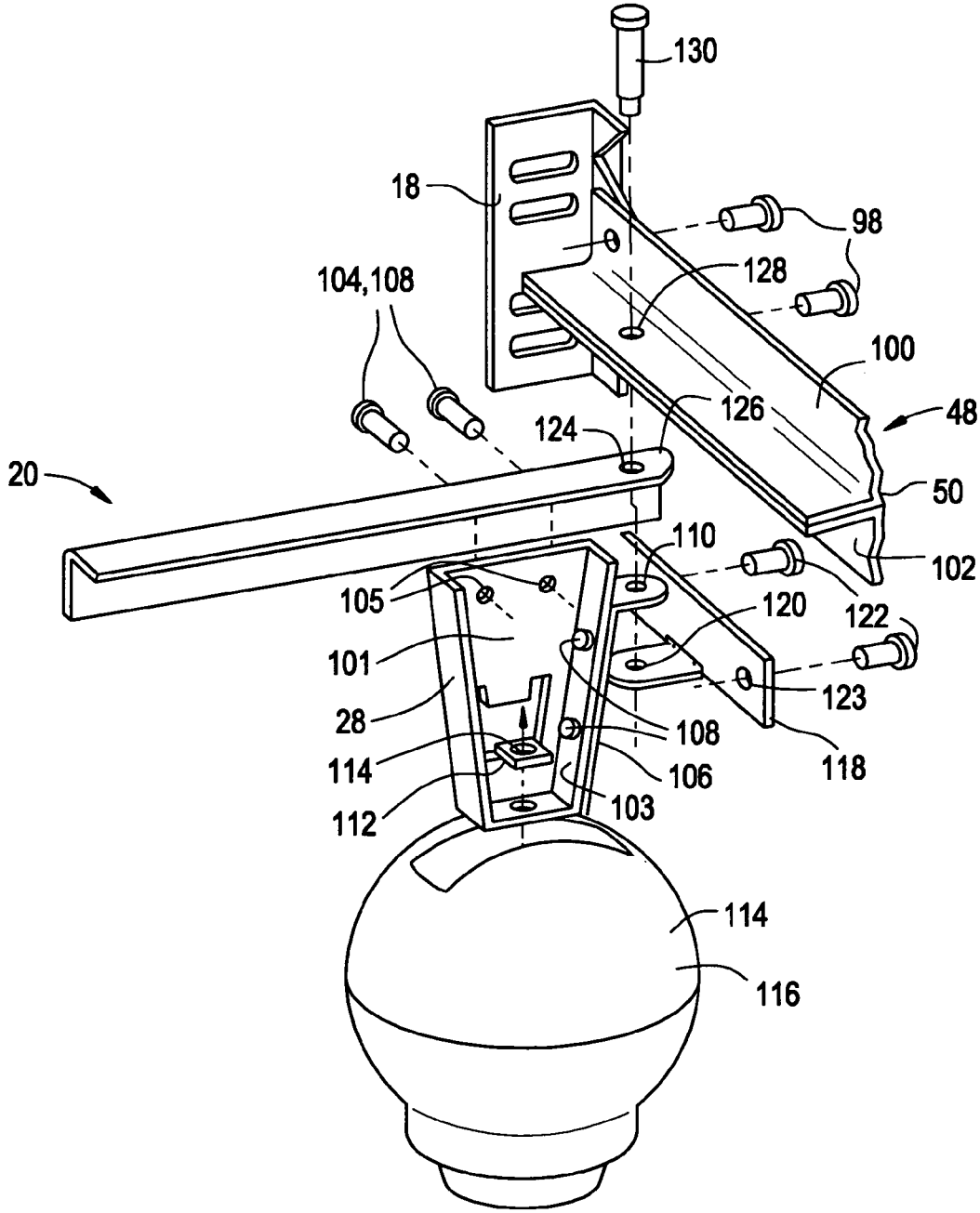
FIG. 7 is an exploded view of a leg of the folding bed frame of the FIG. 4 embodiment affixed to both a cross rail member and a side rail.

Turning to FIG. 7, taken along with FIG. 4, there is shown an exploded view of the leg 28 of the folding bed frame 44 affixed to both a cross rail member 20 and to a side rail 48 and thereby to increase the strength and integrity of the affixation of the leg 28 to those components in the construction of a folding bed frame 44. As shown, the T-shaped side rail 48 can initially create a stronger junction with the headboard bracket 18 since the T-shaped side rail 48 can be affixed by a pair of rivets 98 that pass through both the upper inner surface 100 and lower inner surface 102 of the vertical flange 50 i.e. both above and below the horizontal flange 54 and through corresponding holes in the headboard bracket 18.

The leg 28 basically comprises a main body having a front wall 101 and a side wall 103 that are at or about a right angle with respect to each other. The leg 28 is affixed to the cross rail member 20 by means of a pair of rivets 104 that pass through holes (not shown) in the cross rail member 20 and through a pair of spaced apart holes 105 in the front wall 101 of the leg 28. Leg 28 also has a leg support bracket 106 that is affixed to the leg 28 by rivets 108 that are vertically spaced apart and has an opening 110. The leg 28 also has a caster bracket 112 with an opening 114 that is used to affix a caster or glide to the bottom of the leg 28 and which can be covered by a leg shield 116 in the manner shown and described in U.S. Pat. No. 6,418,578 of Polevoy et al and the disclosure of that patent is hereby incorporated herein in its entirety by reference.

There also is a side rail bracket 118 that is affixed to the lower inner surface 102 of the side rail 48 and which also has a hole 120. Again, the side rail bracket 118 can be affixed to the side rail 48 by means of rivets 122 that are horizontally spaced apart and which pass through holes 123 (only one of which is shown) in the side rail bracket 118. As can also be seen, there is also a hole 124 in the end 126 of the cross rail member 20 that aligns with a corresponding sized hole 128 in the horizontal flange 54 of the side rail 48.

Accordingly, as can now be seen, the leg 28 is affixed to both the cross rail member 20 as well as the side rail 48 and that combined junction is carried out for all of the legs 28 of the folding bed frame 44 shown in FIG. 4. The cross rail member 20 is rotatably affixed to the side rail 48 by means of an elongated rivet 130 that passes through the hole 128 in the horizontal flange 54 of the side rail 48, the hole 124 in the end 126 of the cross rail member 20, the hole 110 in the support flange 106 and the hole 120 in the side rail bracket 118. As such the leg 28 is permanently affixed to the folding bed frame 44 in a strong junction with the leg 28 lower to the floor where there is a mechanical advantage holding the leg 28 stable.

Figure 8:
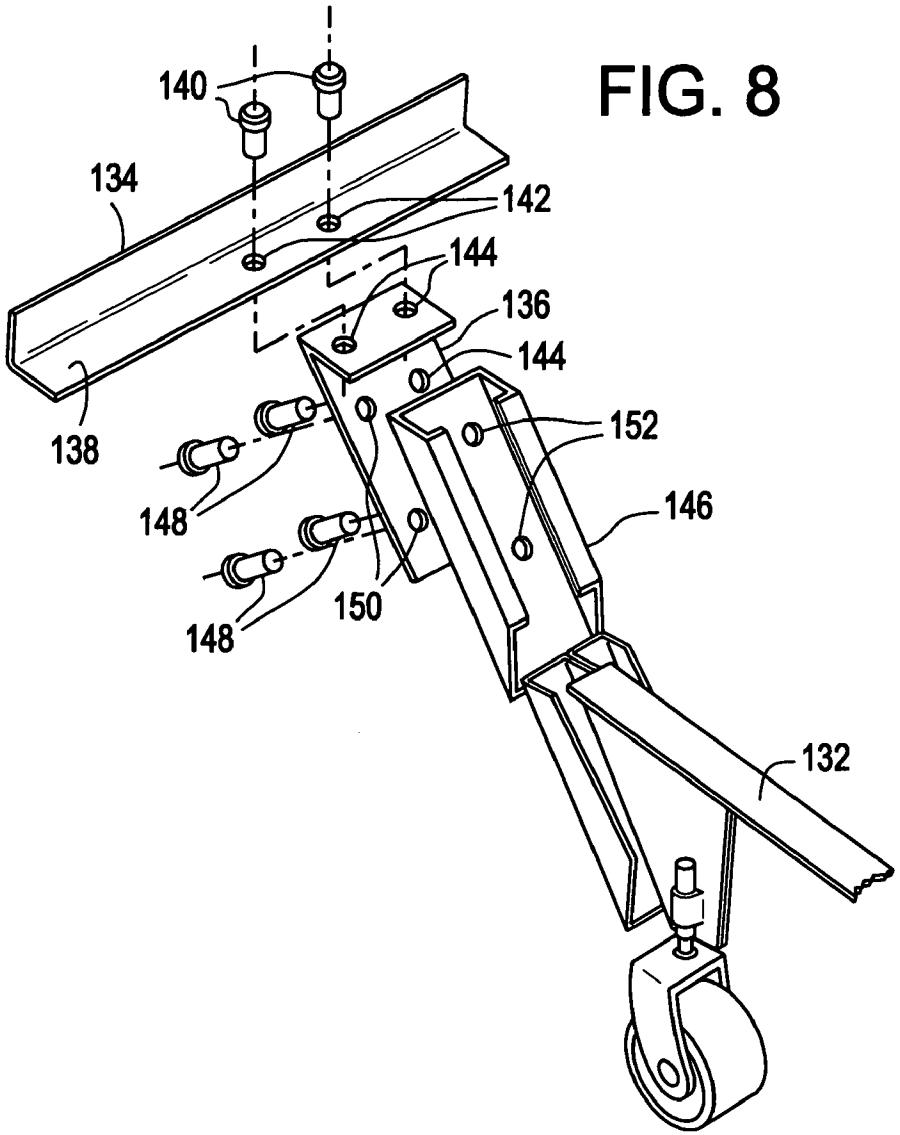
FIG. 8 is an exploded view of a connection between a cross rail and a side rail of a conventional drop together bed frame.

Turning now to FIG. 8, there is shown an exploded view of a connection between a cross rail 132 of a conventional drop together bed frame where the side rail 134 is constructed of the normal L-shaped angle iron. As can be seen, there is required an additional connecting bracket 136 that is affixed to the horizontal flange 138 of the L-shaped side rail 134 by means such as rivets 140 passing through suitable holes 142 in that horizontal flange 138 and holes 144 in the connecting bracket 136 in order to mount the female socket 146 to the side rail 134. The female socket 146 is thereupon affixed to that connecting bracket with rivets 148 passing through holes 150 in the connecting bracket 136 and holes 152 in the female socket 146. Thus, the additional connecting bracket 136 is a necessary component in mounting the female socket 146 in the proper position to receive male flange 154 in joining the cross rail 132 to the side rail 134 in constructing a drop together bed frame.

Figure 9:
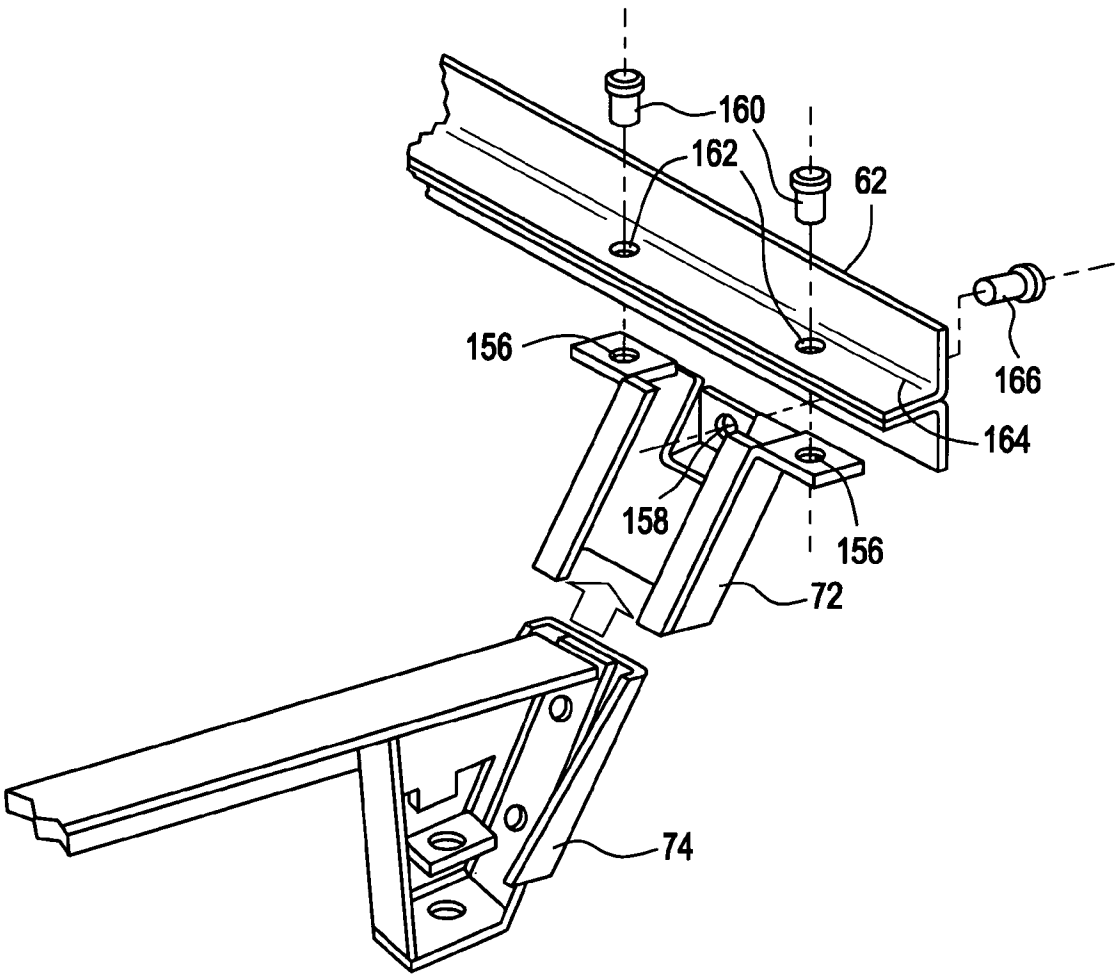
FIG. 9 is an exploded view of a connection between the cross rail and side rail of the FIG. 5 embodiment of the present invention.

Turning to FIG. 9, there is shown an exploded view of a connection between the cross rail 66 and side rail 62 of the FIG. 5 embodiment of the present invention. Taking FIG. 9, along with FIG. 5, therefore, as can be seen, no connecting bracket is required and yet the female socket 72 is firmly and strongly affixed to the T-shaped side rail 62 by the presence of a set of holes 156 in a generally horizontal plane and a hole 158 in a generally vertical plane in the female socket 72. As such, the affixation of the female socket 72 to the side rail 62 is supported in two planes since there are rivets 160 that pass through holes 162 in the horizontal flange 164 of the T-shaped side rail 62 as well as through the holes 156 in the female socket 72 to secure the female socket 72 to the horizontal flange 164. Also, there is a rivet 166 that passes through a hole (not shown) in the vertical flange 168, beneath the horizontal flange 164 and through the hole 158 in the female socket 72 to further secure that female socket 172 to the side rail 62 in two planes about 90 degrees apart. Accordingly, the affixation of the female socket 172 to the side rail 62 is very secure due to the use of the T-shaped side rail 62 of the present invention.

Figure 10A:
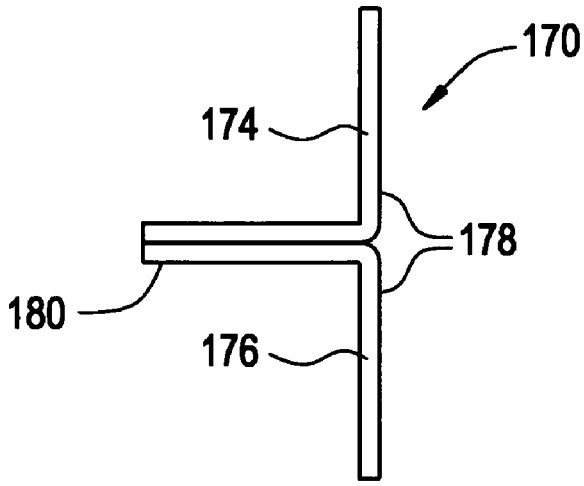
FIGS. 10A and 10B are end views of side rails of the T-shaped cross section of the present invention.
Figure 10B:
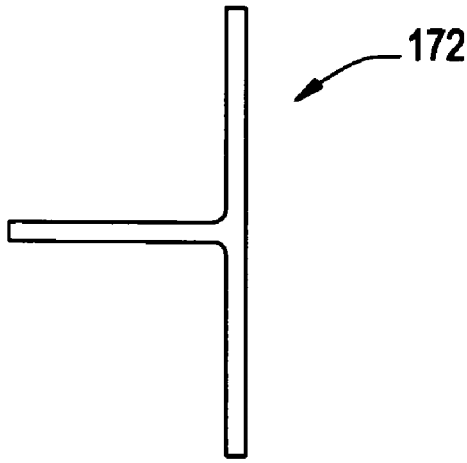

Turning briefly to FIGS. 10A and 10B, there are shown end views of side rails 170 and 172 of the T-shaped cross section of the present invention. In FIG. 10A, the T-shaped side rail 170 is constructed by the securing together of two L-shaped angle irons 174 and 176 by welding, riveting or other means such that the vertical flange 178 is a combination of the vertical flanges of the angle irons 174, 176 and the horizontal flange 180 is an over/under combination of the horizontal flanges of the angle irons 174, 176. In FIG. 10B, the side rail 172 is a one piece, unitary construction forming the vertical flange 178 and the horizontal flange 180 that extends from about midway between the ends of the vertical flange 178. With the one piece, unitary structural T-shaped member, the member cannot only be a side rail but can also be other structural components of the bed frame, including a center beam.

Figure 11:
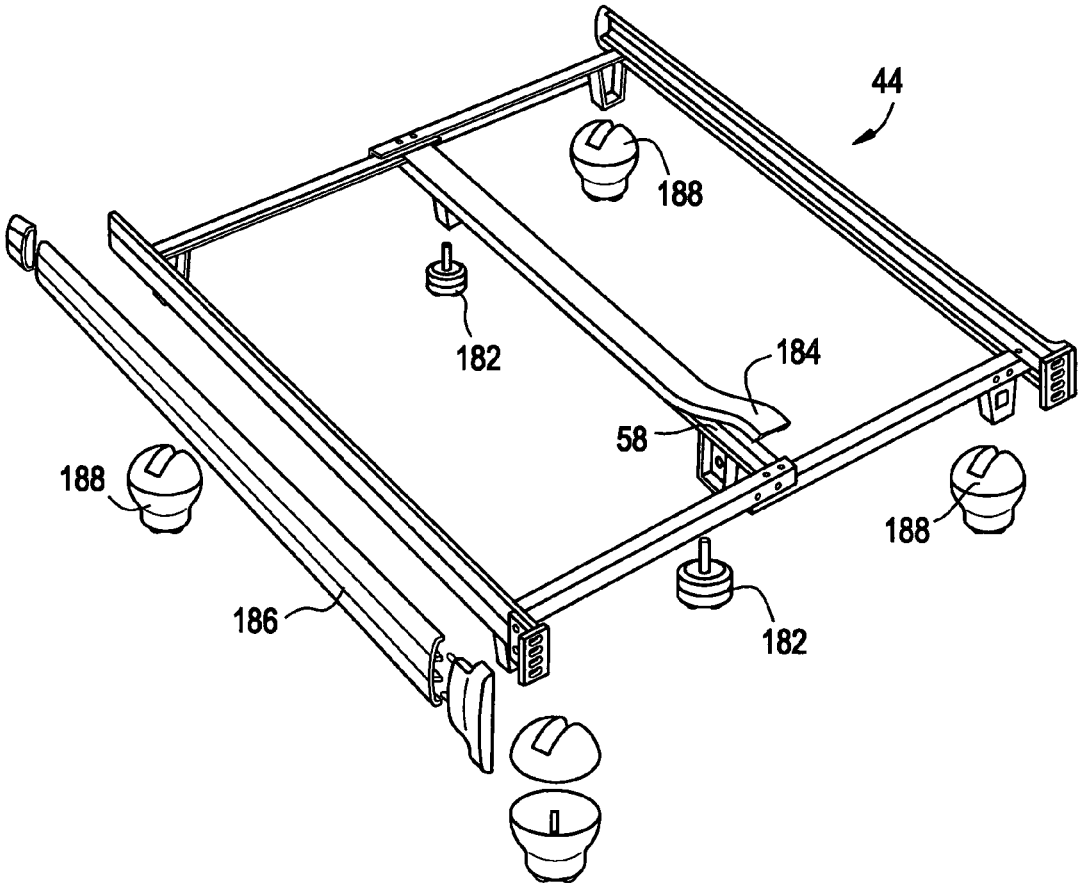
FIG. 11 is a partially exploded view of a bed frame of the present invention illustrating various protective members for assembly thereto.

Turning next to FIG. 11, there is shown a partially exploded view of an adjustable width folding bed frame 44 as shown in FIG. 4 and illustrating the addition of various protective members to improve the appearance of the bed frame as well as provide protection against the inadvertent hitting of the bed frame components by a person where an injury could occur to that person. Thus, there are casters 182 that can be constructed in accordance with the casters shown and described in U.S. Pat. No. 6,568,031 of Polevoy et al, a center beam protective member 184 covering the center beam 58 constructed in accordance with U.S. Pat. No. 7,100,228 of Polevoy et al, a side wall protective member 186 constructed in accordance with U.S. Pat. No. 7,100,228 of Polevoy et al and leg protective members 188 constructed in accordance with U.S. Pat. No. 6,418,578 of Polevoy et al, all of which patents and pending patent applications being incorporated herein in their entirety by reference.

Figure 12:
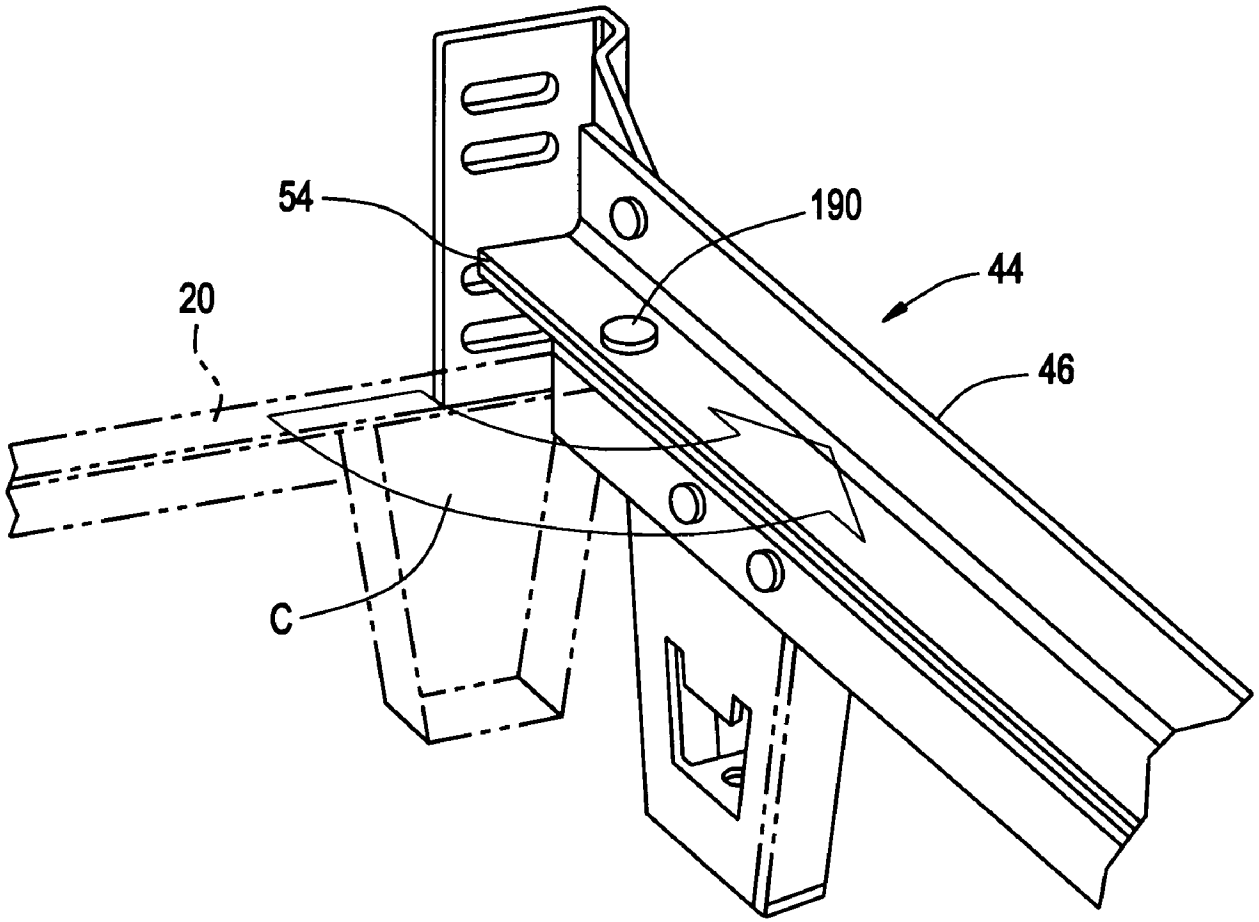
FIG. 12 is a perspective view of a corner of a collapsible bed frame illustrating the folding of a cross rail member with a side rail.

Next, in FIG. 12 there is shown a perspective view of the collapsing of a folding bed frame 44 of the FIG. 4 embodiment where the cross rail member 20 pivots about the rivet 190 in the direction of the arrow C to nest underneath the horizontal flange 54 of the T-shaped side rail 46 to facilitate shipping of the folding bed frame 44.

Figure 13:
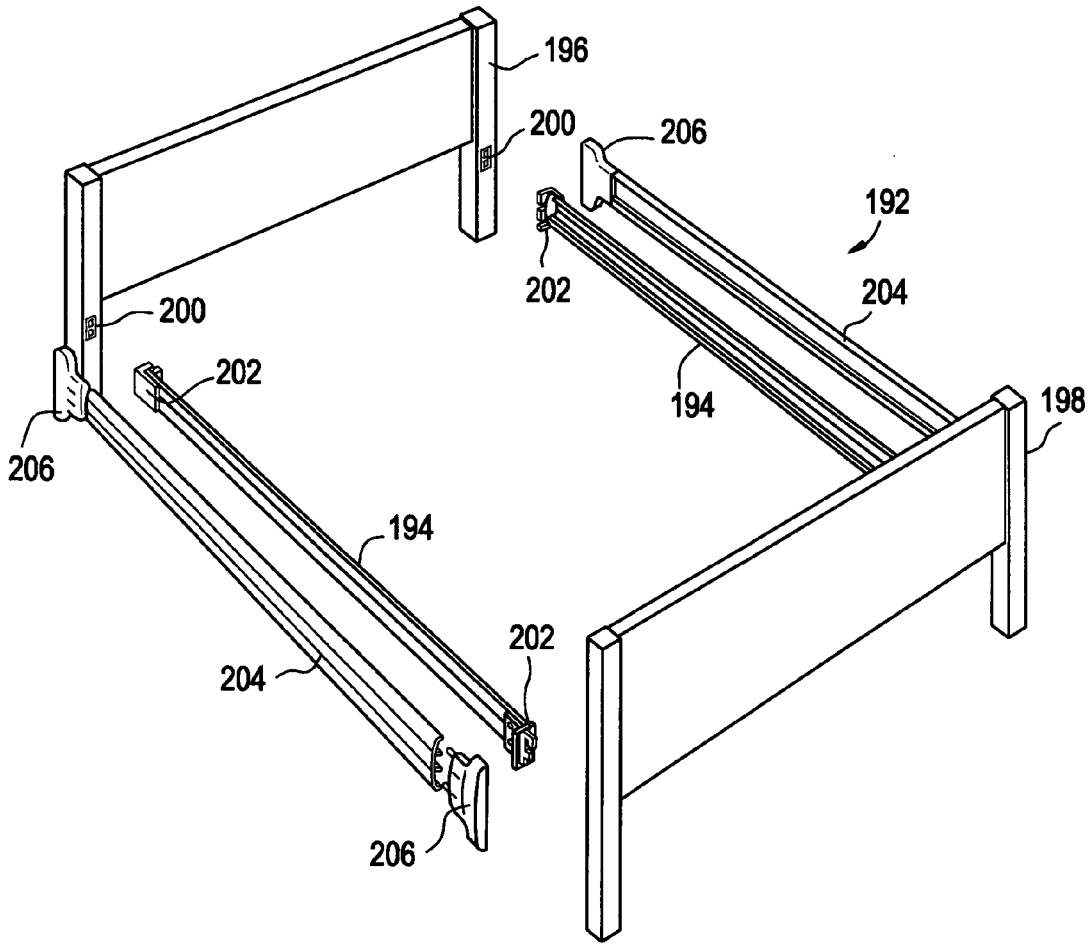
FIG. 13 is an exploded view of a bed frame using hook brackets at the ends of the side rails.

Turning now to FIG. 13, there is shown an exploded view of a bed frame 192 and illustrating the T-shaped side rails 194 that join a headboard 196 and a footboard 198. In this type of bed frame, the side rails 194 are supported by the headboard 196 and footboard 198. In the headboard 196, there can also be seen slots 200 within which are conventionally located a pair of pins, vertically spaced apart (not shown) that laterally cross the slots 200 in order to receive a special bracket having hooks that are provided at the ends of side rails. As such, in FIG. 13, hook brackets 202 are shown and which are adapted to be inserted into the slots 200 and hook over the pins in order to join the side rails 194 to the headboard 196 and the footboard 198.

As also can be seen in FIG. 13, there are protective members 204 that are plastic extrusions that are affixed to the side rails 194 to improve the esthetic appearance of the bed frame 192.

Figure 14A:
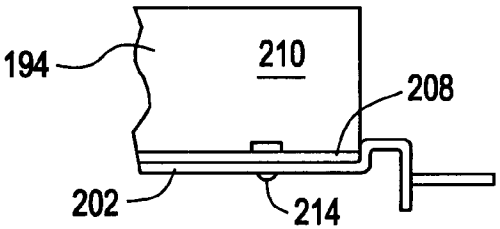
FIGS. 14A, 14B and 14C are, respectively a top view, a side view and an end view of a hook bracket of FIG. 13 affixed to a side rail.
Figure 14C:
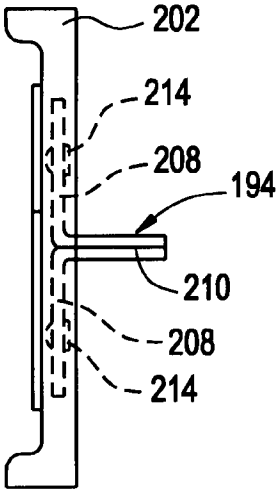
Figure 14B:
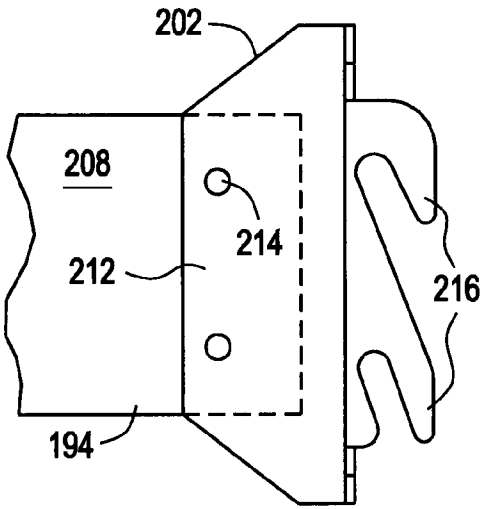

Turning, next to FIGS. 14A, 14B and 14C, there are shown, respectively, a top view, a side view and an end view of a hook bracket 202 affixed to a side rail 194. As can be seen, the side rail 194 has an outer vertical flange 208 and a horizontal flange 210 that extends inwardly from a point about midway between the upper and lower edges of the vertical flange 208 in the manner described with respect to FIG. 5. The hook bracket 202 has a securing flange 212 that is secured to the vertical flange 208 by means such as rivets 214. Thus, by the vertical flange 208 being twice the height as the conventional L-shape angle iron side rails, there can be two rivets 214 sufficiently spaced apart so as to improve the integrity of the junction between the hook bracket 202 and the side rail 194, thereby strengthening the overall junction.

As such with the hook bracket 202 more strongly affixed to the side rail 194 due to the T-shaped configuration of the side rail 194, the hooks 216 can engage the pins and there is less likelihood that the hook bracket 202 will become loose in its connection to the side rail 194.

Figure 15A:
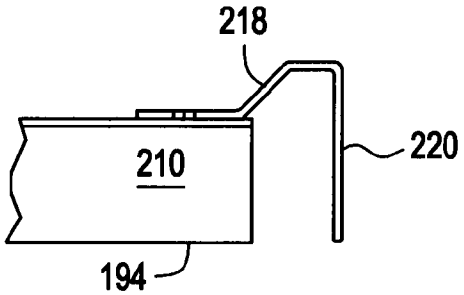
FIGS. 15A, 15B and 15C are, respectively a top view, a side view and an end view of a headboard bracket used with the present invention.
Figure 15B:
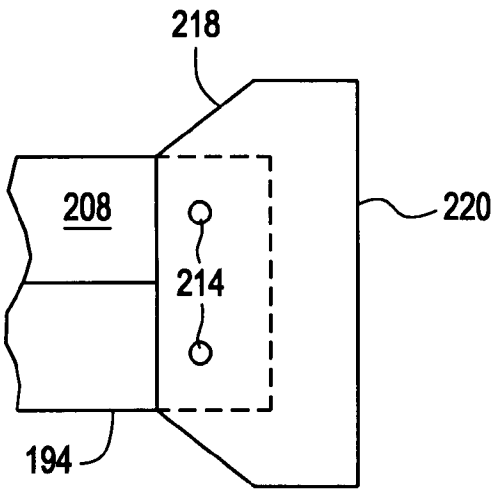
Figure 15C:
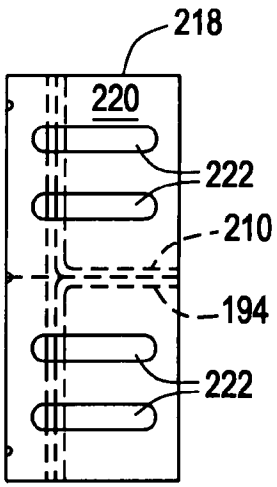

In FIGS. 15A, 15B and 15C, there is shown, respectively, a top view, side view and an end view of a slotted headboard bracket 218 and which can be affixed to the side rail 194 in the same manner as the hook bracket 202 of FIGS. 14A-14C to achieve a junction with added strength and rigidity. As such there are, again, two rivets 214 that are spaced well apart and above and below the location of the horizontal flange 210. The forward face 220 of the headboard bracket 218 has a plurality of elongated slots 222 that are provided in order to affix the headboard bracket 218 to a headboard by means such as screws.

With the use of the T-shaped side rail therefore, the present invention allows the current metal bed frame to have a bracket to attach to a headboard for decorative purposes that is solid and well supported. This creates the impression of a finished bed like a complete wood or metal bed where the side rails are supported by the legs of a headboard and footboard. With this type of bed frame, however, the bed frame is self supporting and there is no footboard.

The result is a headboard that is not weight bearing and is suspended from the side rails on brackets. Due to the height of a typical headboard, stability is often an issue. The current headboard brackets 218 are mounted to the vertical flange 208 of the side rail 194. The L-shaped, conventional, side rail, however, provides relatively a small area for a junction with a headboard bracket and typically the rivets are assembled side to side along the vertical flange.

With the present invention, however, using a T-shape cross section of side rail 194, the side rail 194 and headboard are assembled with rivets 214 vertically aligned with significantly more separation and which provides significantly more stability at the headboard top. The double vertical flange of the present side rail is the geometry that allows for that advantage. Additionally, the intermediate horizontal flange stabilizes the vertical flange allowing for the superior rigidity.

Figure 16A:
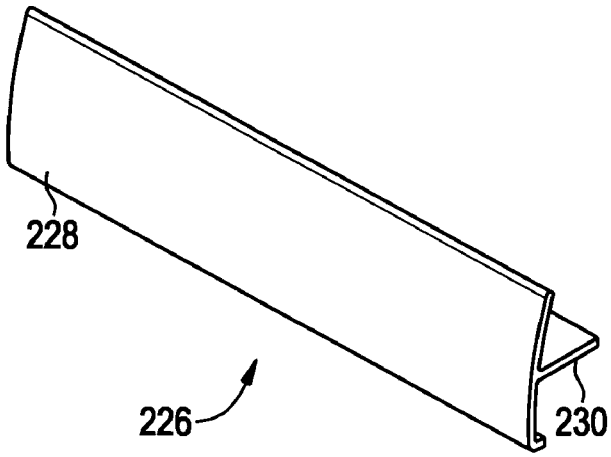
FIGS. 16A and 16B are, respectively, a perspective view and an end view of a structural member usable for constructing a bed frame.
Figure 16B:
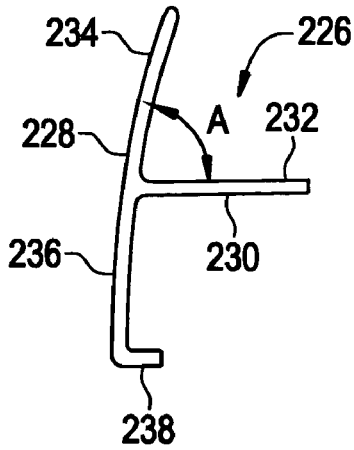

Turning now to FIGS. 16A and 16B, there is shown a perspective view and an end view, respectively, of a exemplary embodiment of a structural member 226 that can be used in the construction of a bed frame. As can be seen in the FIG. 16A, 16B embodiment the structural member 226 is in its orientation as a side rail and therefore has a generally curved or non-linear vertical flange 228 and a generally horizontal flange 230 extending outwardly from the generally vertical flange 228 and, when the structural member 226 is employed as a side rail in a bed frame, the upper horizontal surface or shelf 232 of the horizontal flange 230 serves to support the box spring and mattress thereon. In this embodiment, the horizontal flange 230 meets the generally vertical flange 226 at an angle A that is less than 90 degrees although that angle could be at 90 degrees or slightly more than 90 degrees and the horizontal flange 230 divides the vertical flange 228 into a first segment 234 and a second segment 236. There also can be an inwardly directed edge flange 238. As shown, the edge flange 238 is formed on the second segment 236, however, it can be seen that the edge flange may be formed on either the first segment 234, the second segment 236 or both segments 234, 236.

Figure 17A:
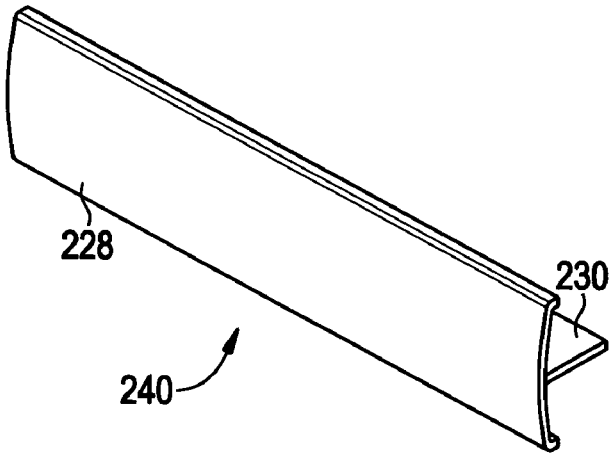
FIGS. 17A and 17B are, respectively, a perspective view and an end view of another structural member usable for constructing a bed frame.
Figure 17B:
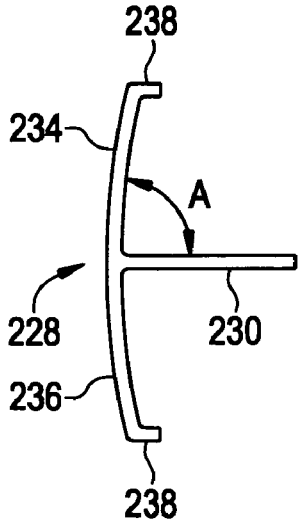

Turning to the next exemplary embodiment, in FIGS. 17A and 17B, there is a perspective view and an end view of another structural member 240 usable for constructing a bed frame and shown in the orientation as if the structural member is a side rail. The same identification numbers are used for corresponding elements of FIGS. 16A and 16B. In this embodiment, the angle A is 90 degrees and there is an inwardly directed edge flange 238 at the ends of both of the first and second segments 234, 236. Again the vertical flange 228 is curved or non-linear.

Figure 18A:
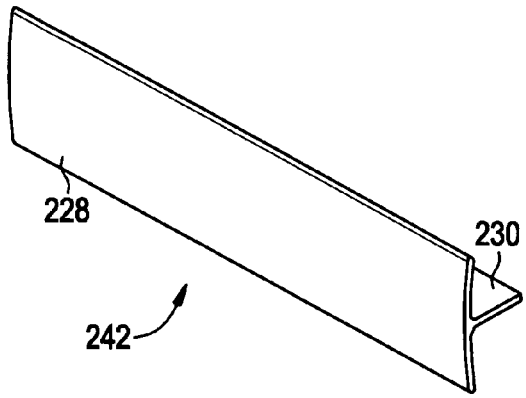
FIGS. 18A and 18B are, respectively, a perspective view and an end view of a further structural member usable for constructing a bed frame.
Figure 18B:
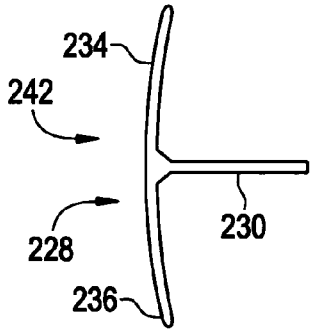

Turning to the next exemplary embodiment, in FIGS. 18A and 18B, there is a perspective view and an end view of another structural member 242 usable for constructing a bed frame and shown in the orientation as if the structural member is a side rail. The same identification numbers are used for corresponding elements of FIGS. 16A and 16B. In this embodiment, the angle A is 90 degrees and the generally vertical flange 228 is curved inwardly in the direction of the horizontal flange 230.

Figure 19A:
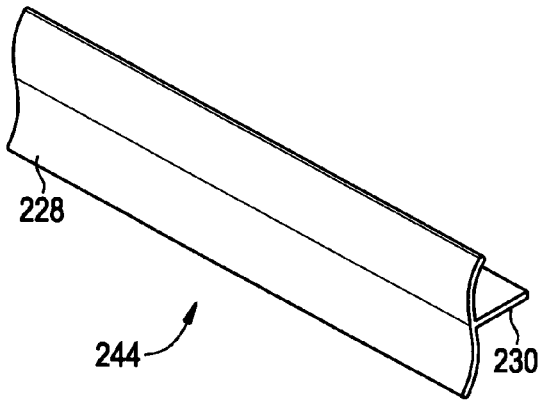
FIGS. 19A and 19B are, respectively, a perspective view and an end view of a still further structural member usable for constructing a bed frame.
Figure 19B:
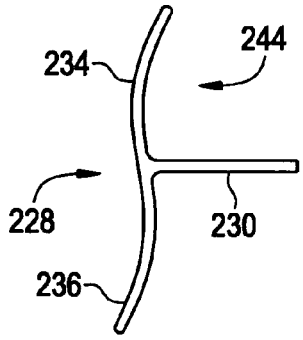

Turning to the next exemplary embodiment, in FIGS. 19A and 19B, there is a perspective view and an end view of another structural member 244 usable for constructing a bed frame and shown in the orientation as if the structural member is a side rail. The same identification numbers are used for corresponding elements of FIGS. 16A and 16B. In this embodiment, the angle A is 90 degrees and the generally vertical flange 228 is curved in the formation of an S shape.

Figure 20A:
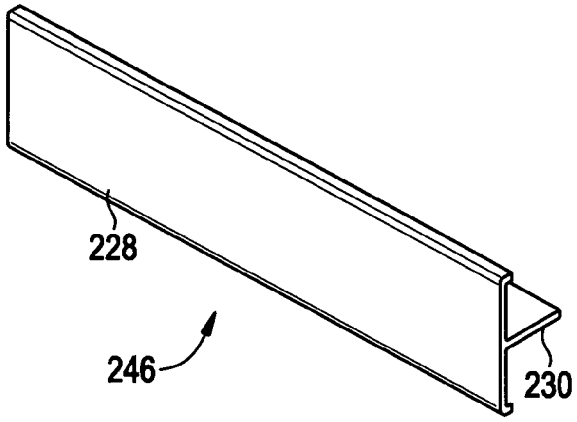
FIGS. 20A and 20B are, respectively, a perspective view and an end view of a structural member usable for constructing a bed frame.
Figure 20B:
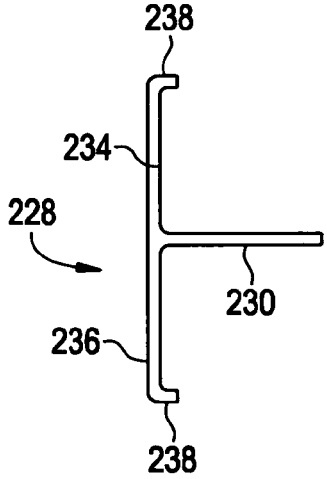

Turning to the next exemplary embodiment, in FIGS. 20A and 20B, there is a perspective view and an end view of another structural member 234 usable for constructing a bed frame and shown in the orientation as if the structural member is a side rail. The same identification numbers are used for corresponding elements of FIGS. 16A and 16B. In this embodiment, the angle A is 90 degrees and the generally vertical flange 228 is straight or linear and has inwardly directed flanges 238 at both ends of the first and second segments 234 and 236.

Figure 21A:
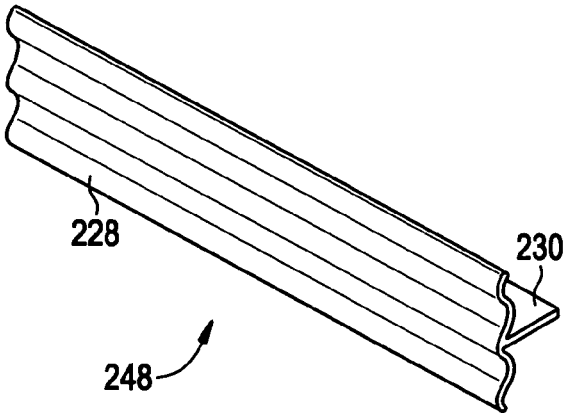
FIGS. 21A and 21B are, respectively, a perspective view and an end view of a structural member usable for constructing a bed frame.
Figure 21B:
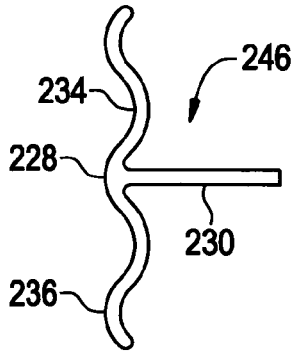

Turning to the next exemplary embodiment, in FIGS. 21A and 21B, there is a perspective view and an end view of another structural member 248 usable for constructing a bed frame and shown in the orientation as if the structural member is a side rail. The same identification numbers are used for corresponding elements of FIGS. 16A and 16B. In this embodiment, the angle A is 90 degrees and the generally vertical flange 228 is curved, or non-linear, to the extent that both of the first and second segments 234, 236 are S-shaped.

Figure 22A:
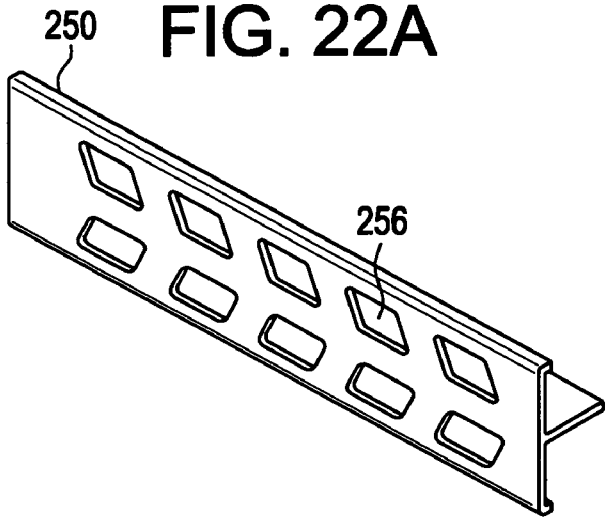
FIGS. 22A, 22B and 22C are perspective views illustrating openings formed in structural members usable for constructing a bed frame.
Figure 22B:
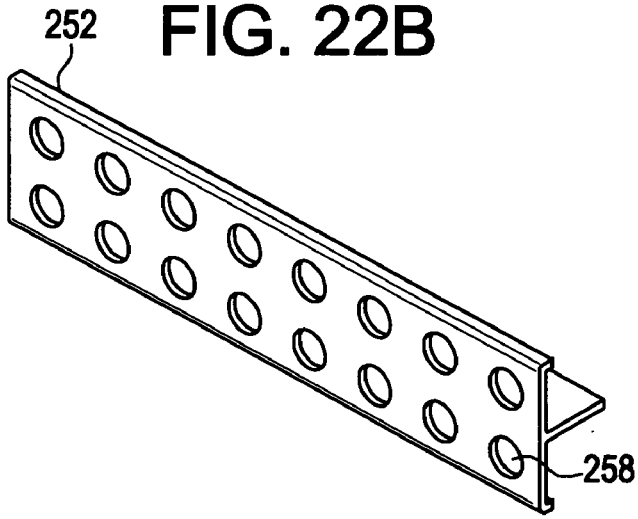
Figure 22C:
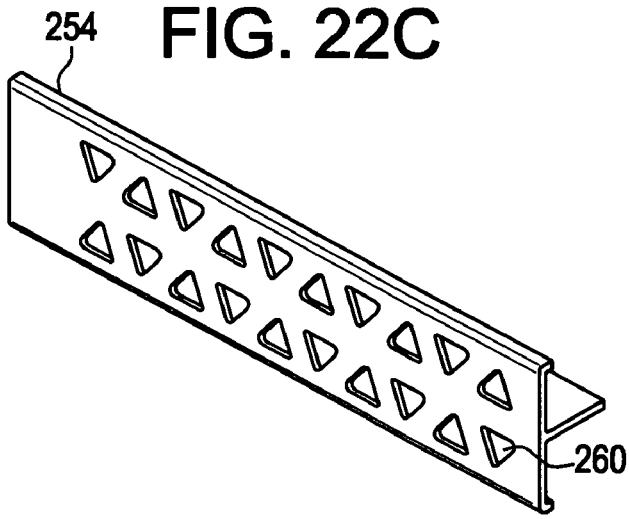

In FIGS. 22A, 22B and 22C, there is shown perspective views of various structural members 250, 252 and 254 and illustrating the openings 256, 258 and 260 spaced apart and located along the lengths of the structural members 250, 252 and 254. The use of the openings 256, 258 and 260 is to reduce the weight of the structural members 250, 252 and 254 without compromising the strength thereof necessary for the construction of a bed frame. As can be seen, the openings may be of various shaped openings, including the parallelogram openings 256, circular or oval openings 258 and triangular openings 260.

Figures 23A, 23B:
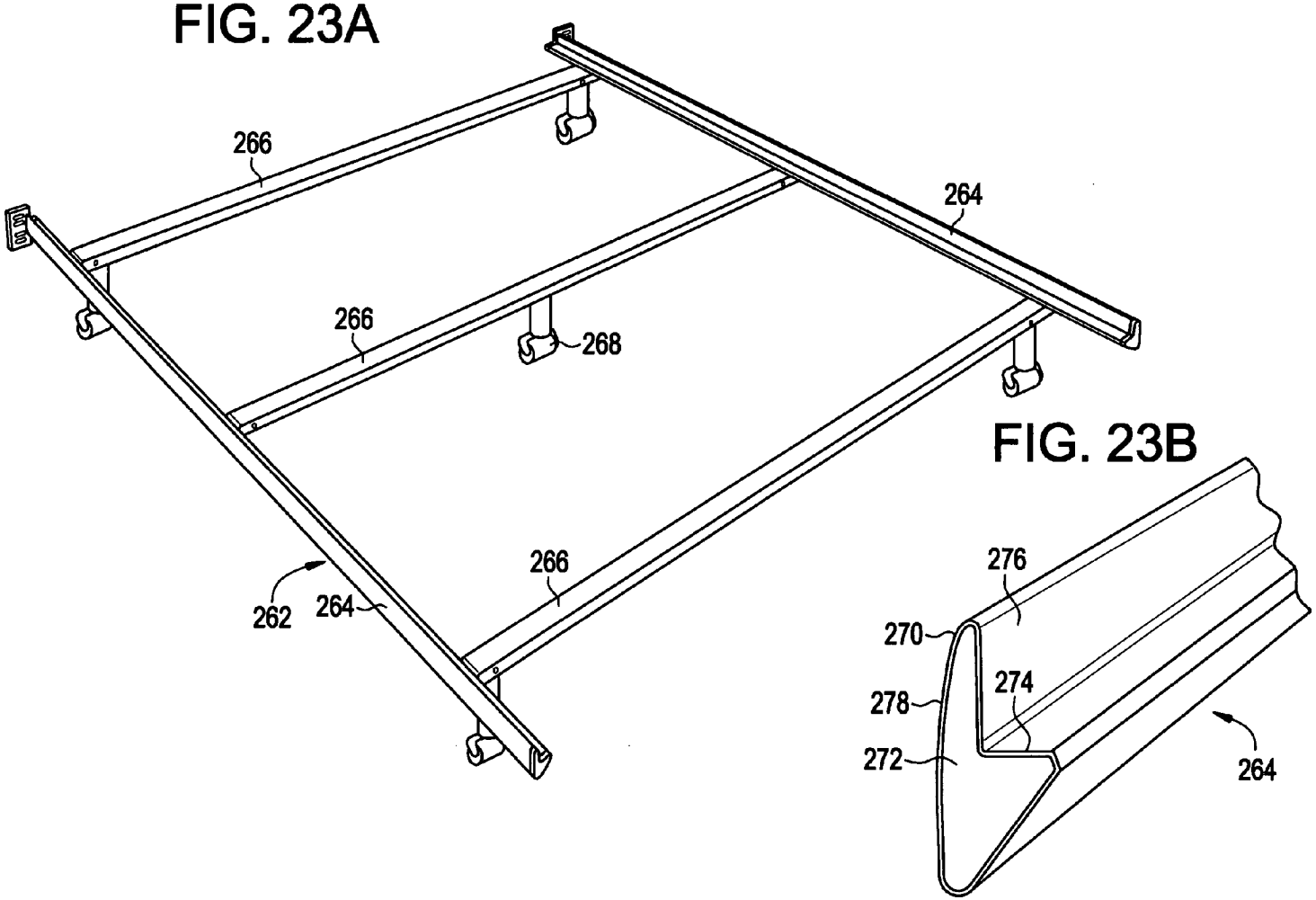
FIGS. 23A and 23B are, respectively, a perspective view of a bed frame and an end perspective view of a structural member.

Turning now to FIGS. 23A and 23B, there is shown a perspective view of a bed frame 262 and an end perspective view of a structural member 264 as its side rails. The bed frame 262 includes the structural members 264 of the present invention used as side rails and also includes cross members 266 in a conventional construction along with wheels 268. In FIG. 23B, there can be seen the structural member 264 which comprises an external shaped metal shell 270 surrounding a hollow area 272. The metal shell 270 is specially shaped and includes a horizontal shelf 274 that, as can be seen, is used to support a box spring and mattress when the bed is fully assembled. There is also formed a vertical surface 276 that is contiguous with the horizontal shelf 274 and is present to retain the box spring in its desired location and prevent it from moving laterally. As such, when the bed frame 262 is assembled, the vertical surfaces 276 of opposite structural members 264 as side rails sandwich the box spring therebetween and hold the box spring in position. The metal shell 270 continuously surrounds the hollow area 272 and, in the embodiment of FIGS. 23A and 23B there is an outer segment 278 that is non-linear, being curved slightly outwardly to create a good esthetic appearance of the bed frame 262.

Figure 24A:
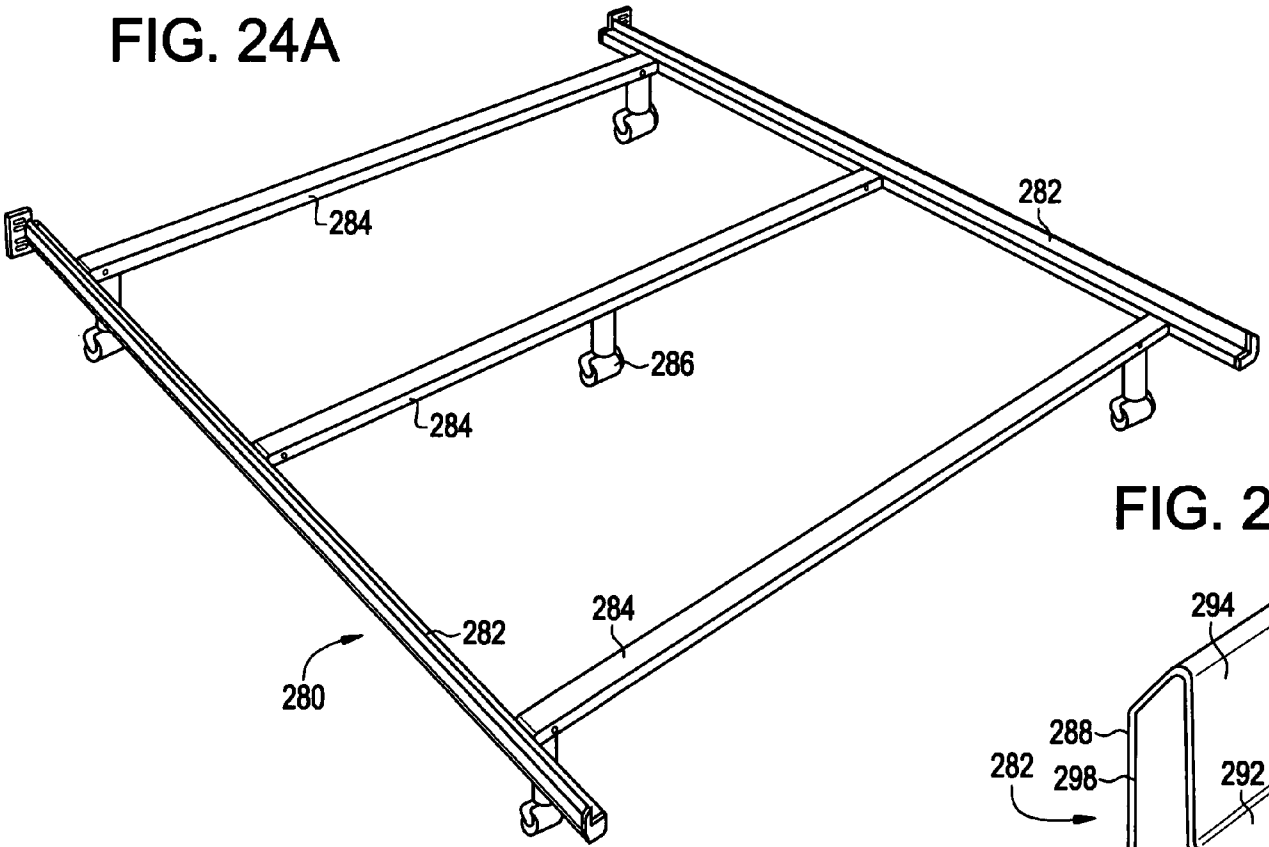
FIGS. 24A and 24B are, respectively, a perspective view of a bed frame and an end perspective view of another structural member.
Figure 24B:
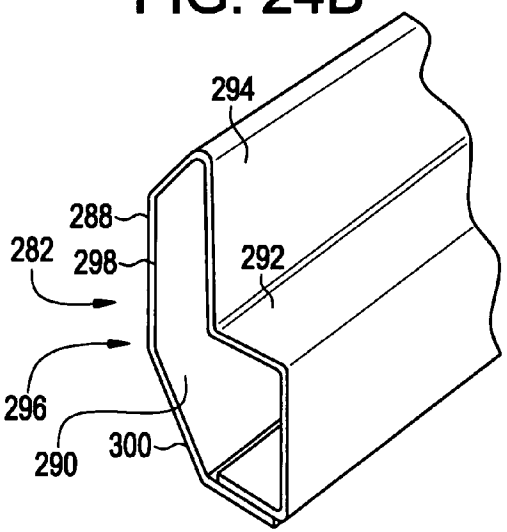

Turning next to FIGS. 24A and 24B, there is shown a perspective view of a bed frame 280 and an end perspective view of a structural member 282 as its side rails. Again the bed frame comprises the structural members 282 of the present invention used as side rails as well as cross members 284 in a conventional construction along with wheels 286. The structural member 282 again is an external shaped metal shell 288 surrounding a hollow area 290. The metal shell 288 includes a horizontal shelf 292 that supports a box spring and mattress and continuously surrounds the hollow area 290. Again, there is a vertical surface 294 that is contiguous to the horizontal shelf 292 and serves to retain a box spring in its desired position on the bed frame 280. In the embodiment of FIGS. 24A and 24B there is an outer segment 296 that has an upper vertical portion 298 and a lower diagonal portion 300. As with the embodiment of FIGS. 23A and 23B, the outer surface of the outer segment 296 creates a good esthetic appearance of the bed frame 280.

Figure 25A:
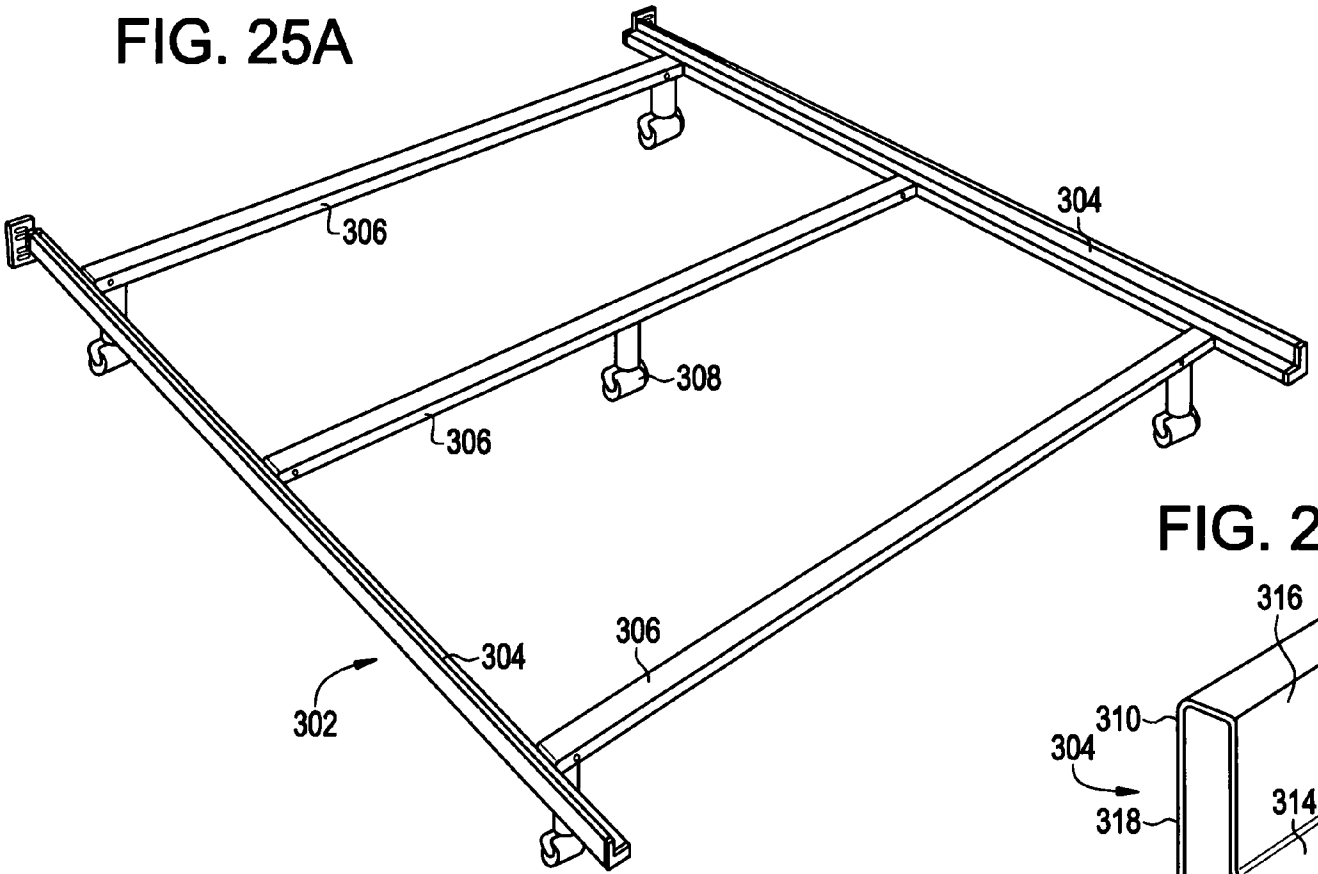
FIGS. 25A and 25B are, respectively, a perspective view of a bed frame and an end perspective view of a further structural member.
Figure 25B:
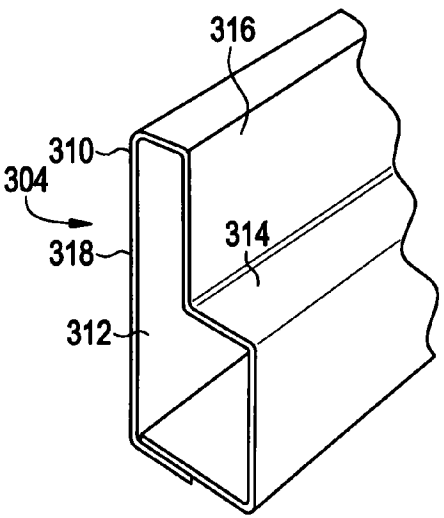

Turning next to FIGS. 25A and 25B, there is shown a perspective view of a bed frame 302 and an end perspective view of a structural member 304 as its side rails. Again the bed frame 302 comprises the structural members 304 of the present invention used as side rails as well as cross members 306 in a conventional construction along with wheels 308. The structural member 304 again is an external shaped metal shell 310 surrounding a hollow area 312. The metal shell 310 includes a horizontal shelf 314 that supports a box spring and mattress and continuously surrounds the hollow area 312. Again, there is a vertical surface 316 that is contiguous to the horizontal shelf 314 and serves to retain a box spring in its desired position on the bed frame 302. In the embodiment of FIGS. 25A and 25B there is an outer segment 318 that is flat and vertical. As with the embodiment of FIGS. 23A and 23B, the outer surface of the outer segment 318 presents a good esthetic appearance of the bed frame 302.

Figure 26A:
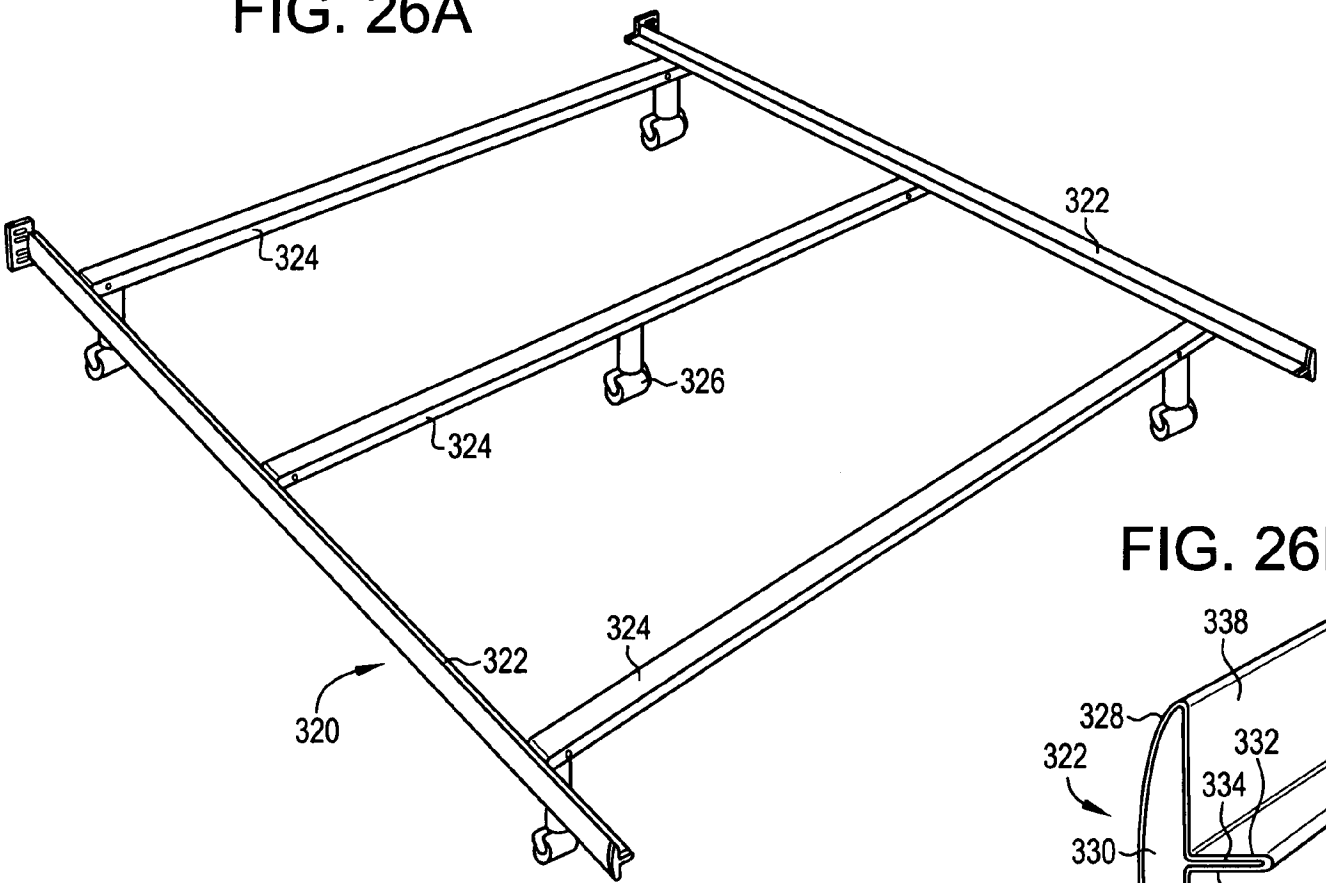
FIGS. 26A and 26B are, respectively, a perspective view of a bed frame and an end perspective view of a still further structural member.
Figure 26B:
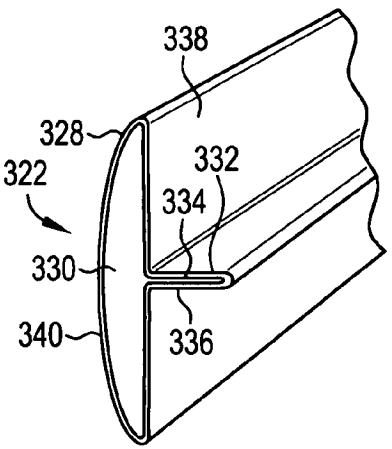

Turning next to FIGS. 26A and 26B, there is shown a perspective view of a bed frame 320 and an end perspective view of a structural member 322 as its side rails. Again, the bed frame comprises the structural members 322 of the present invention used as side rails as well as cross members 324 in a conventional construction along with wheels 326. The structural member 322 again is an external shaped metal shell 328 surrounding a hollow area 330. The metal shell 328 includes a horizontal shelf 332 that is comprised of upper and lower parallel segments 334, 336 that support a box spring and mattress. There is a vertical surface 338 that is contiguous to the horizontal shelf 332 and serves to retain a box spring in its desired position on the bed frame 320. In the embodiment of FIGS. 26A and 26B, there is an outer segment 340 that is curved or non-linear. As with the embodiment of FIGS. 23A and 23B, the outer surface of the outer segment 340 presents a good esthetic appearance of the bed frame 320.

Figure 27A:
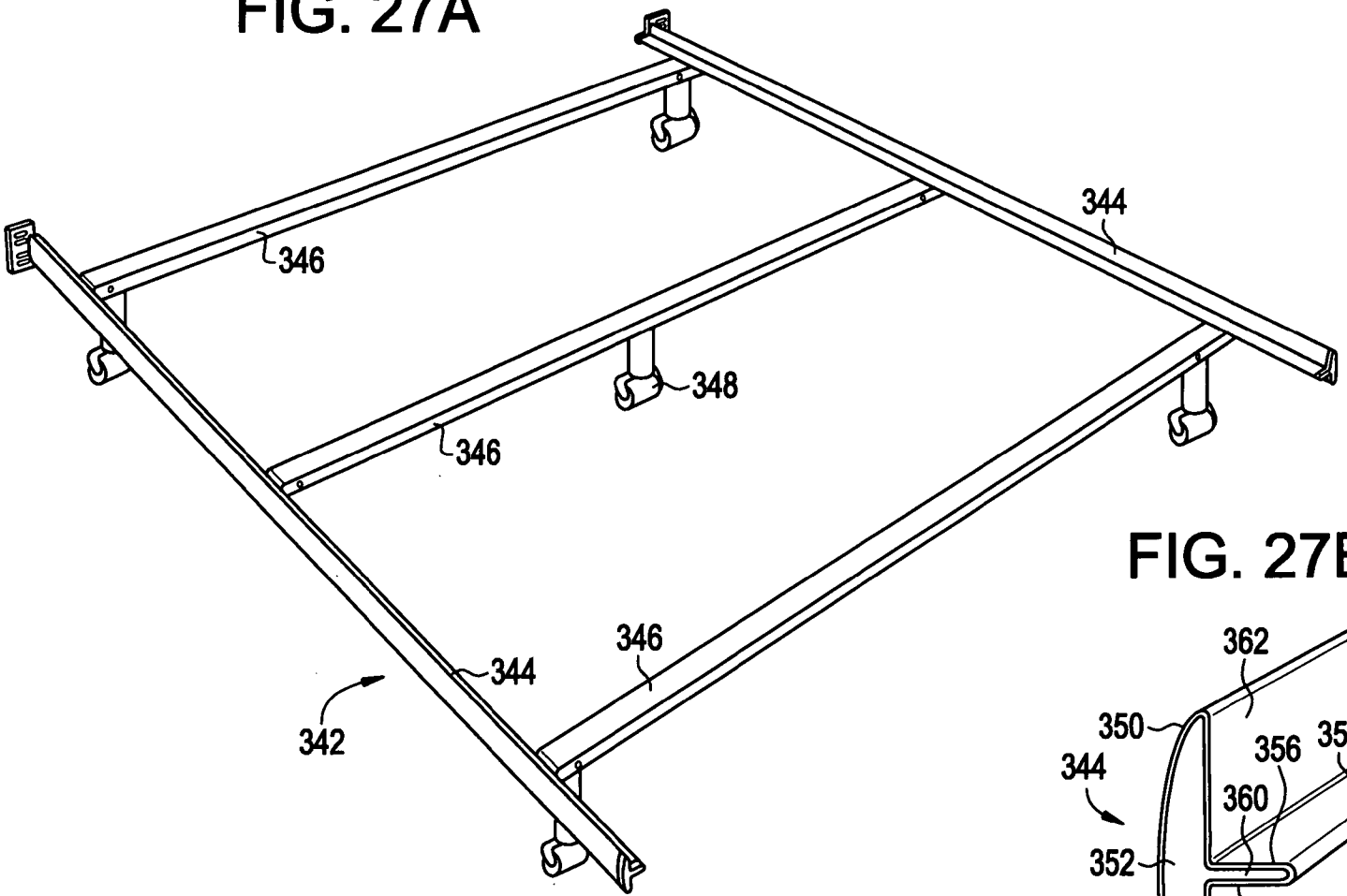
FIGS. 27A and 27B are, respectively, a perspective view of a bed frame and an end perspective view of a still further structural member.
Figure 27B:
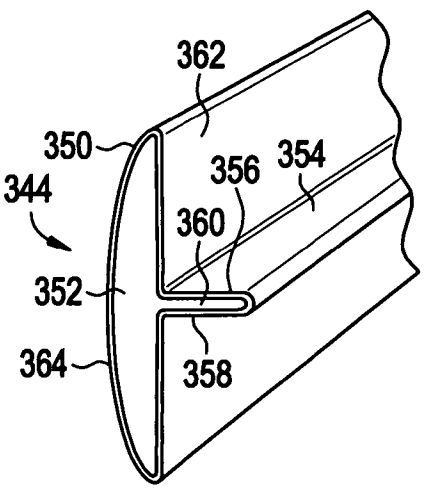

Turning next to FIGS. 27A and 27B, there is shown a perspective view of a bed frame 342 and an end perspective view of a structural member 344 as its side rails. Again the bed frame comprises the structural members 344 of the present invention used as side rails as well as cross members 346 in a conventional construction along with wheels 348. The structural member 344 again is an external shaped metal shell 350 surrounding a hollow area 352. The metal shell 350 includes a horizontal shelf 354 that is comprised of upper and lower segments 356, 358 that are spaced apart to create a space 360 therebetween to support a box spring and mattress. There is a vertical surface 362 that is contiguous to the horizontal shelf 354 and serves to retain a box spring in its desired position on the bed frame 342. In the embodiment of FIGS. 27A and 27B, there is an outer segment 364 that is curved or non-linear. As with the embodiment of FIGS. 23A and 23B, the outer surface of the outer segment 364 presents a good esthetic appearance of the bed frame 342.

Figure 28:
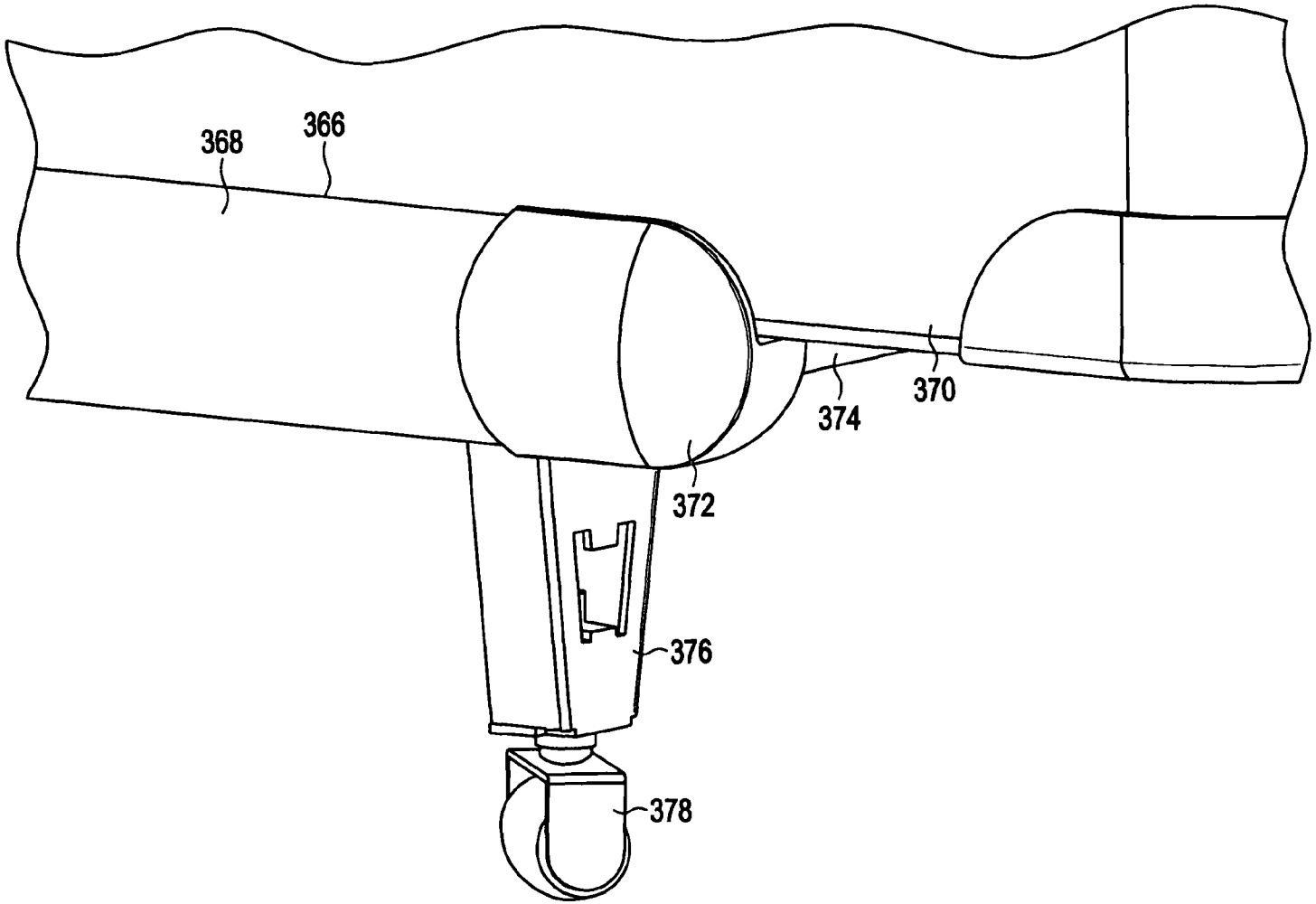
FIG. 28 is a perspective view of an exemplary embodiment of a side rail and end cap therefore, constructed in accordance with the present invention.

Turning to FIG. 28, there is shown a perspective view of an exemplary embodiment of a side rail 366 and, as can be seen, the side rail 366 has an outer surface 368 i.e. the surface facing away from the box spring 370 that is supported by the side rail 366. There is an end cap 372 affixed to the end of the side rail 366 and which will be later explained in detail. The side rail 366 is a structural component of a normal bed frame, previously shown in FIG. 1, for example, and which includes a cross rail member 374 and a leg 376 that extends downwardly from the cross rail member 374 with a caster 378 attached to the bottom of the leg 376.

Figure 29:
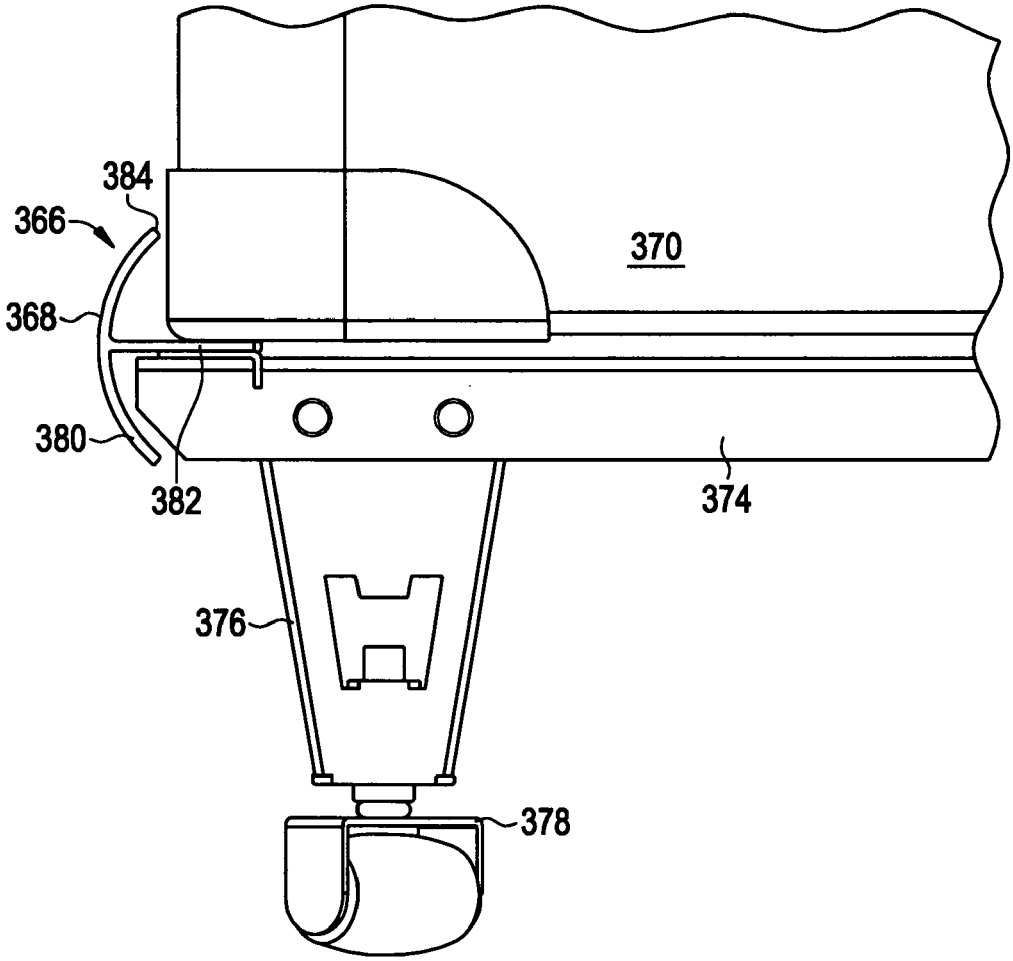
FIG. 29 is an end view of the side rail embodiment of FIG. 28.

Turning now to FIG. 29, there is shown an end view of the embodiment of FIG. 28 without the end cap and illustrating the configuration of the cross section of the side rail 366. Thus, the overall cross section of the side rail 366 is generally T-shaped having a vertical flange 380 and a horizontal flange 382 extending inwardly toward the box spring 370 for supporting the box spring 370. The vertical flange 380 can be seen to be curved or non-linear as well, of course, as the outer surface 368 thereof, thereby creating a pleasing exterior appearance to the side rail 366. The upper point 384 of the vertical flange 380 serves to retain the box spring 370 from side to side movement in its location atop of the side rail 366 while the horizontal flange 382 is positioned beneath the box spring 370 serves to support the box spring 370. In this embodiment, the curved or non-linear vertical flange 380 is a continual arc of a circle, however, other non-linear designs are applicable. The side rail 366 presents a good esthetic appearance.

Figure 30:
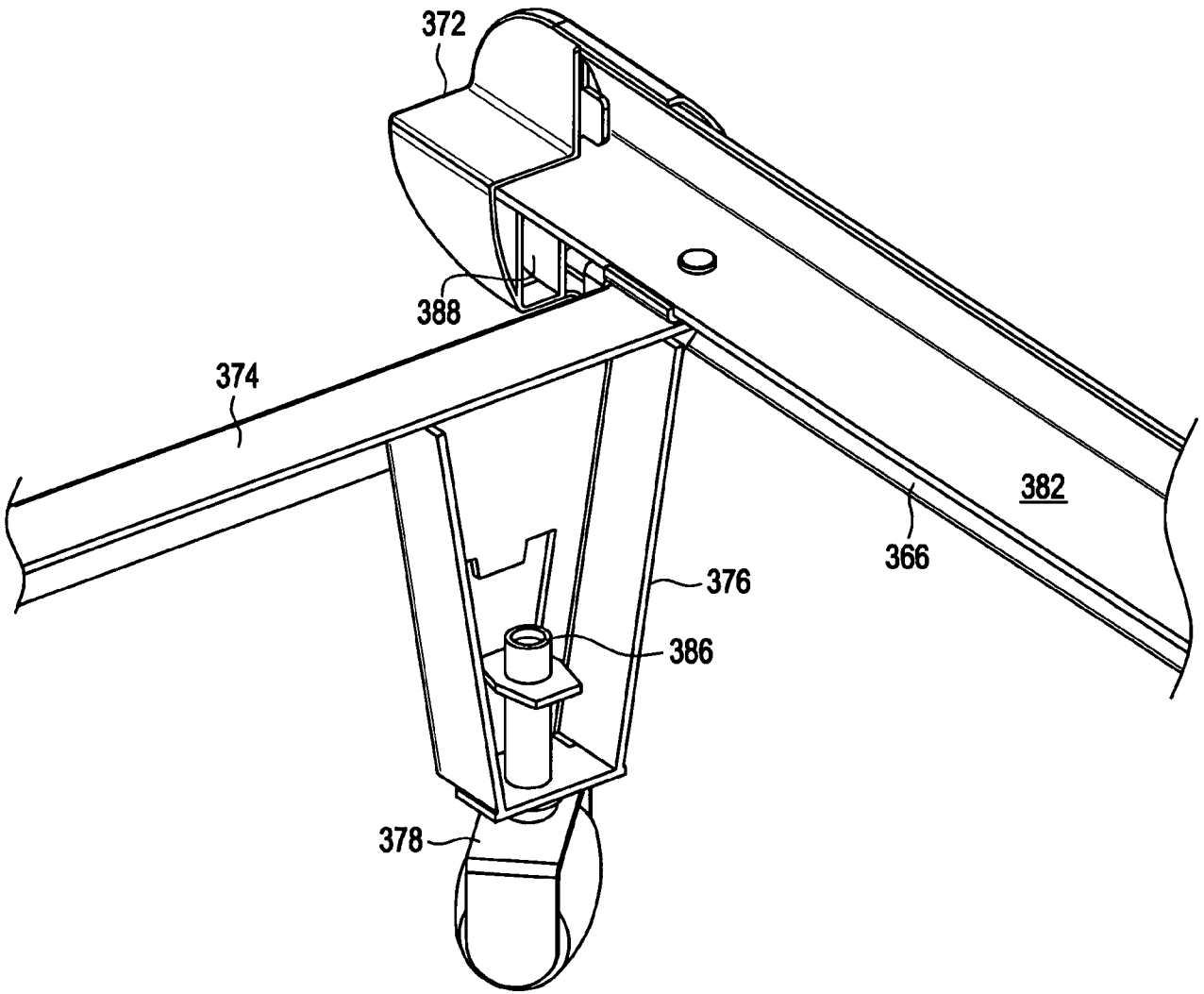
FIG. 30 is a perspective view illustrating an inside corner of a bed frame using the side rail of FIG. 28.

Turning next to FIG. 30, there is shown a perspective view of an inside corner of a bed frame having a side rail 366 and a cross rail member 374. In this view, the inside structure of the leg 376 is visible and which includes a vertical boss 386 that receives an upstanding stem (not shown) of the caster 378 to retain the caster to the bottom of the leg 376 in conventional fashion. In addition, it can be seen that the end cap 372 can simply be press fitted onto the end of the side rail 366 by means of a vertical and horizontal recess (not shown) formed in the end cap 372. By such construction there is formed at least one recessed area 388 within the interior of the end cap and which can be used for a number of purposes, one of which being a secretive location to store valuable items. In addition, the space created underneath the horizontal flange 382 along the length of the side rail 366 is well suited for the location of a light, such as a string of lights, such as a string of LED's or small incandescent lights that illuminate underneath the bed frame.

Figure 31:
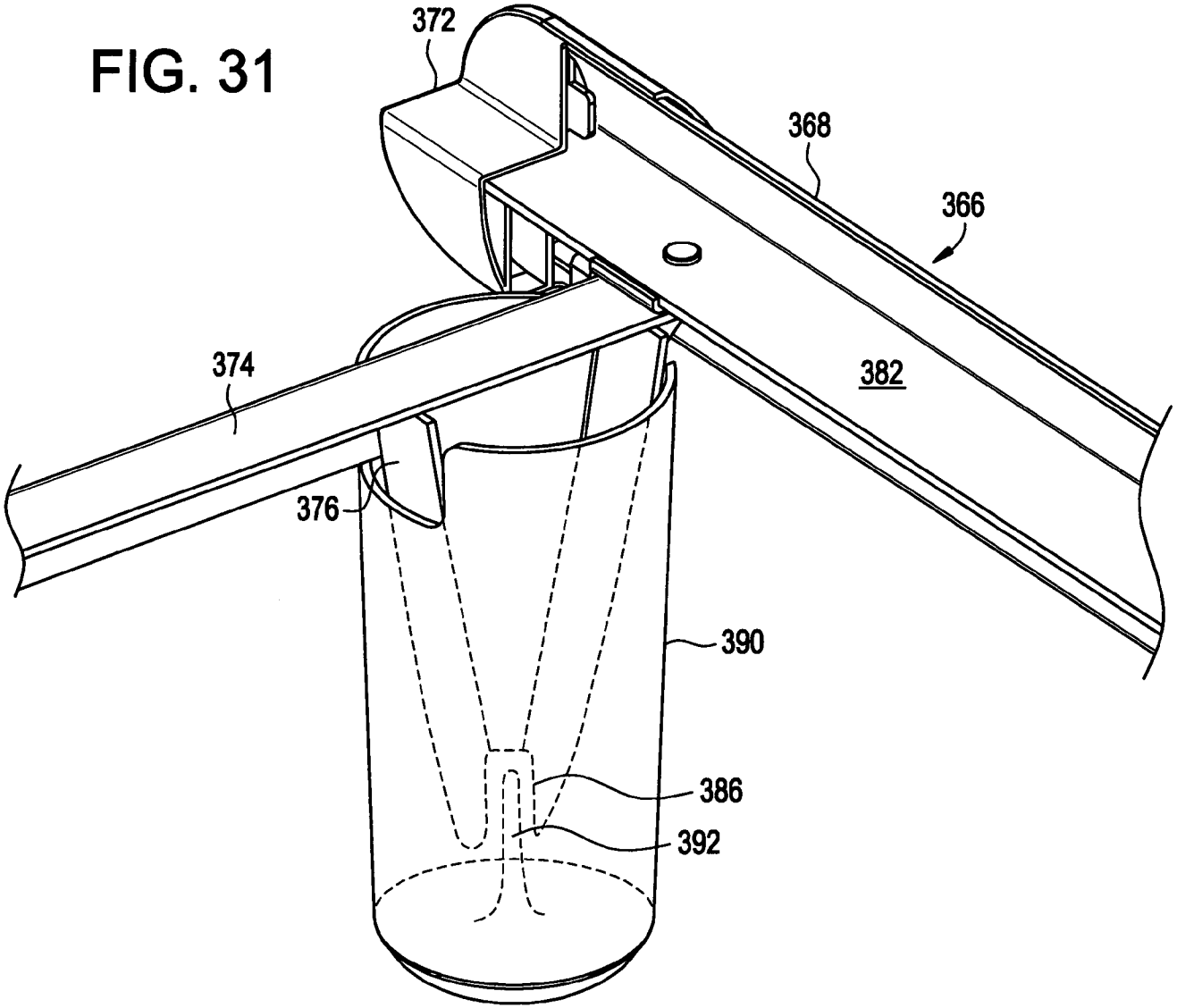
FIG. 31 is a perspective view of the FIG. 28 embodiment and further showing a protective cover for the leg of a bed frame.

In FIG. 31, there is shown a perspective view of the present side rail 366 with a protective shield 390 covering the leg 376 (FIG. 30). The protective shield 390 can be installed by providing an upstanding stem 392 within the protective shield 390 that can be inserted into the vertical boss 386 (FIG. 30) in the manner shown and described in U.S. Pat. No. 6,418,578 of Richard Polevoy et al, and the disclosure of that patent is hereby incorporated herein in its entirety by reference.

Figure 32:
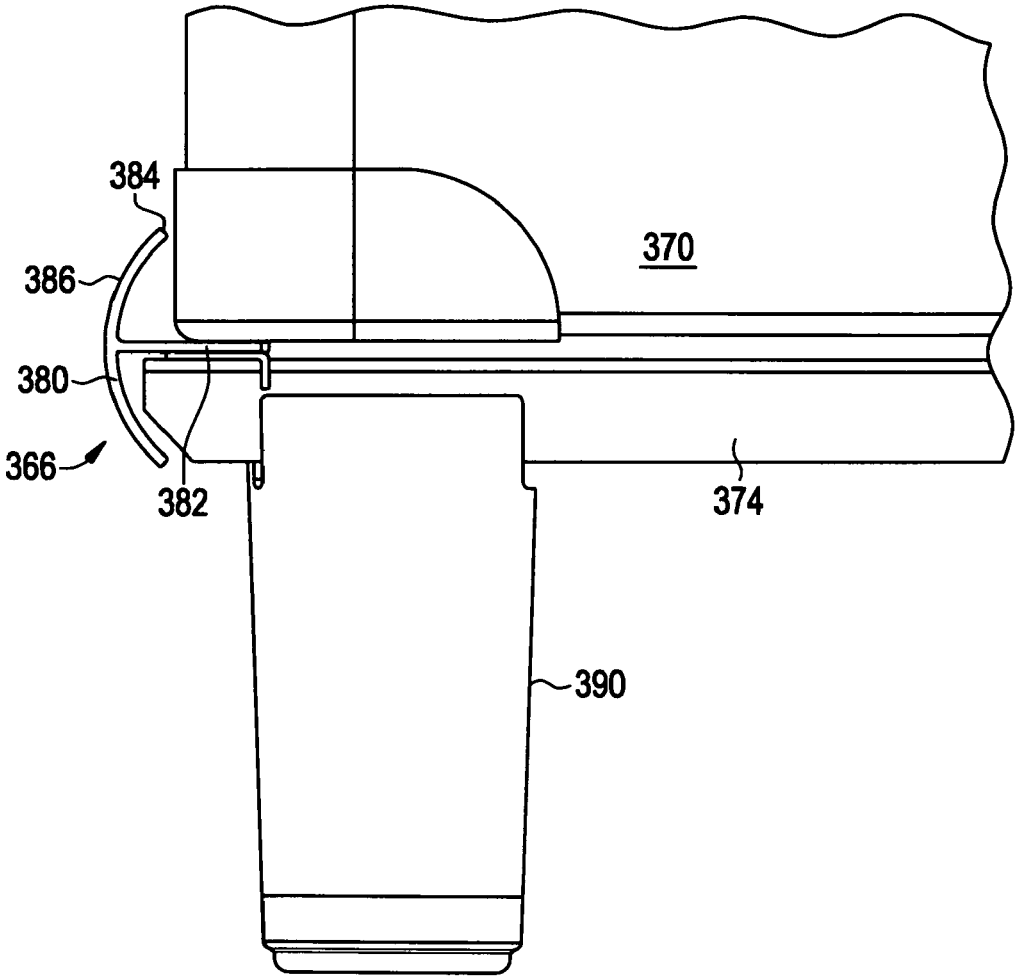
FIG. 32 is an end view of the side rail of FIG. 28 and the protective cover of the present invention.

Turning to FIG. 32, there is shown an end view of the side rail 366, without the end cap, with the protective shield 390 in position protecting the leg (FIG. 31) and, as can be seen, by the combination of the non-linear outer surface 368 and the curved shape of the protective shield 390, there is enhanced protection against injury to persons inadvertently encountering the curved, non-linear surface and thus reduced potential for injury. The non-linear surfaces complement each other to protect against the injury to a person's shin or lower leg in striking a sharp edge of the side rail or leg of a normal bed frame while presenting an enhanced, overall attractive look to the appearance thereof.

Figure 33:
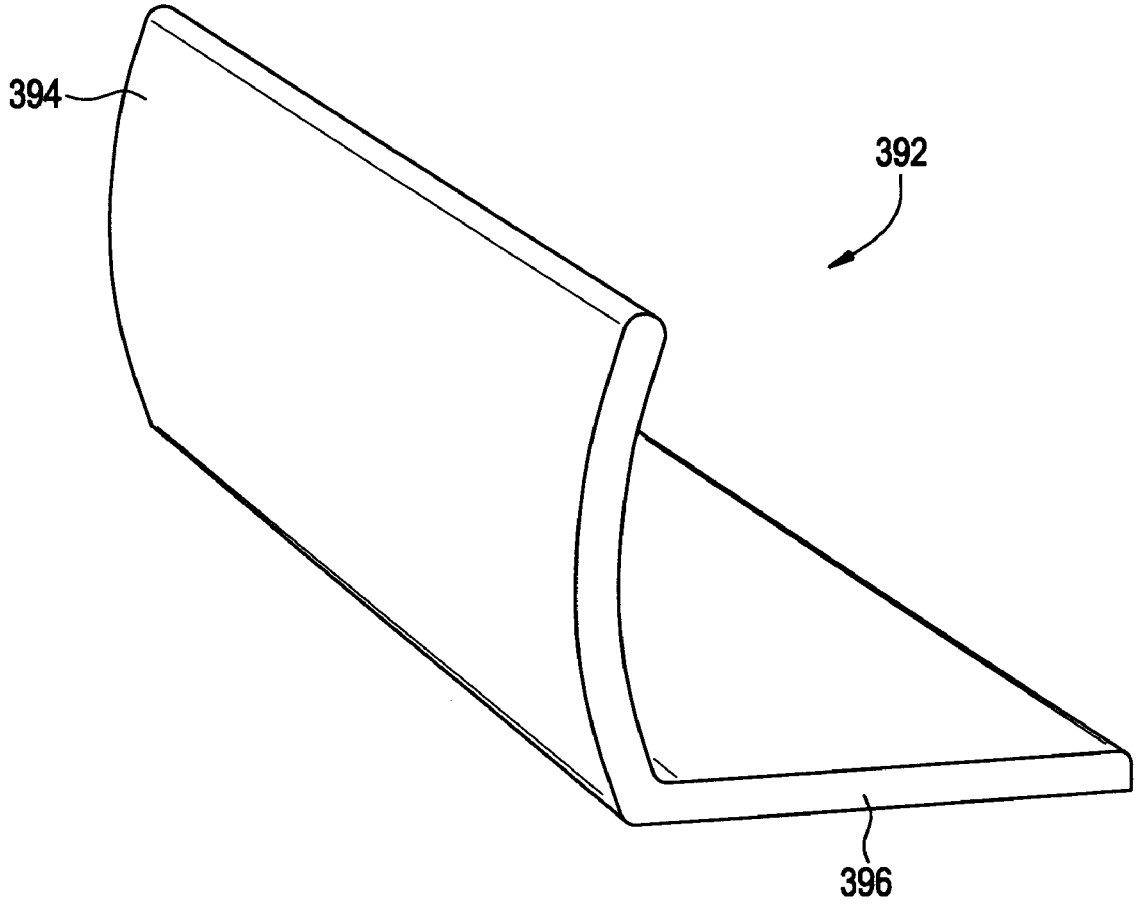
FIG. 33 is a perspective view of a L-shaped structural member that can be used in constructing a bed frame.
Figure 34:
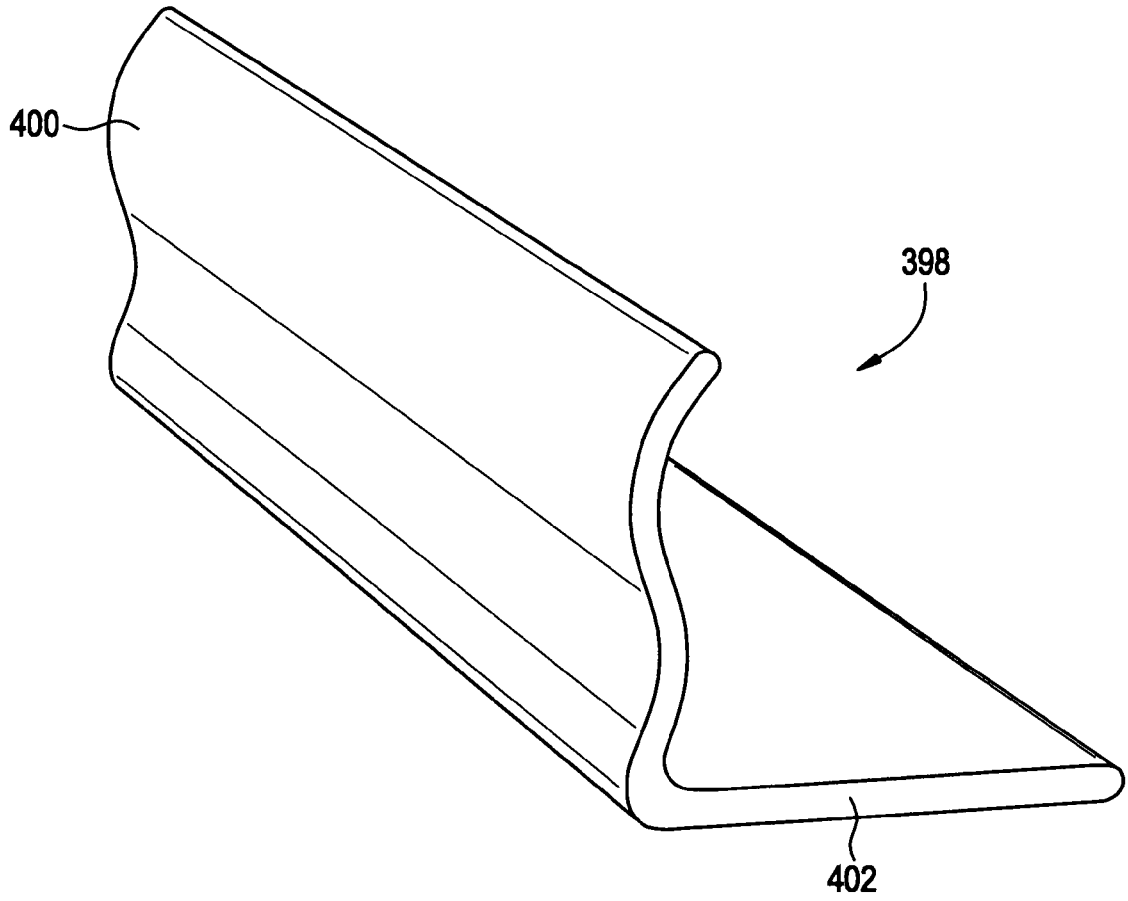
FIG. 34 is a perspective view of another L-shaped structural member usable in constructing a bed frame.

Turning next to FIG. 33, there is shown a perspective view of a L-shaped structural member 392 for a bed frame and, as can be seen the structural member has a vertical flange 394 and a horizontal flange 396 when the structural member 392 is positioned for use as a side rail. In this embodiment, the vertical flange 394 is curved or non-linear as a single curve and which itself can be used as a side rail or can be affixed to another similar, but inverted, shaped structural member to form a T-shaped structural member having a single arced combined vertical flange similar to the one piece structural member shown in FIGS. 18A and 18B.

Finally there is shown in Fig, 34, another L-shaped structural member 398 having a vertical flange 400 and a horizontal flange 402 and where the vertical flange is S-shaped and which can be used itself as a side rail or other structural member of a bed frame can also be affixed together to another similar shaped, but inverted structural member to form a T-shaped structural member having a non-linear or curved vertical flange similar to the one piece structural member shown in FIGS. 21A and 21B.

While the present invention has been set forth in terms of a specific embodiment of embodiments, it will be understood that the present bed frame structural members herein disclosed may be modified or altered by those skilled in the art to other configurations. Accordingly, the invention is to be broadly construed and limited only by the scope and spirit of the claims appended hereto.

What is claimed is:

1. A bed frame assembly comprising:

a pair of parallel spaced apart side rails and at least one cross member spanning between the side rails, at least one of the side rails being comprised of metal and having a T-shaped cross section wherein the side rail is oriented such that a first flange is generally vertically oriented and a second flange is generally horizontally oriented and extends outwardly from the first flange dividing the first flange into a first segment and a second segment wherein a lateral cross-section of at least one of the first segment or the second segment is non-linear.

2. The bed frame assembly as defined in claim 1 wherein the first flange is curved inwardly toward the center of the bed frame and wherein the first flange has external edges and wherein at least one of the external edges has an inwardly directed edge flange.

3. The bed frame assembly as defined in claim 1 wherein the lateral cross-section of the first flange is an S configuration.

4. The bed frame assembly as defined in claim 1 wherein the second flange extends outwardly from the first flange at about the center of the first flange thereby forming about equal first and second segments and wherein a lateral cross-section of at least one of the first or second segments is shaped in the form of an S configuration.

5. The bed frame assembly as defined in claim 1 further including an end cap affixed to an end of the side rail.

6. The bed frame assembly as defined in claim 5 wherein the end cap has an accessible, generally concealed, interior space.

7. A side rail for constructing a bed frame, the side rail comprised of metal and having a T-shaped cross section, wherein the side rail comprises an elongated, T-shaped cross section comprising a first flange with a second flange extending outwardly from the first flange dividing the first flange into a first segment and a second segment and further wherein the first flange is curved inwardly in the direction the second flange extends outwardly from the first flange.

8. The side rail as defined in claim 7 wherein the first flange has external edges and wherein at least one of the external edges has an inwardly directed edge flange.

9. The side rail as defined in claim 7 wherein a lateral cross-section of the first flange is shaped in the form of an S configuration.

10. The side rail as defined in claim 7 wherein at least one of the first and a second segments has a lateral cross-section in the form of a shallow S configuration.

11. A bed frame assembly constructed of structural members including a pair of parallel spaced apart side rails and at least one cross member spanning between the side rails, at least one of the structural members comprising a unitary, single piece hollow structural member having an external shaped metal shell forming an inner, enclosed space, the unitary, single piece structural member having a lateral cross section forming a generally horizontal shelf and having a vertical segment facing inwardly of the bed frame assembly.

12. The bed frame assembly of claim 11 wherein the assembly has an outer curved segment.

13. The bed frame assembly of claim 11 wherein the at least one structural member has an outer segment having an intermediate vertical portion and upper and lower diagonal portions.

14. The bed frame assembly of claim 13 wherein the at least one structural member has an outer segment extending generally vertically.

15. The bed frame assembly of claim 11 wherein the shelf is comprised of two planar segments generally parallel to each other and wherein the upper and lower segments of the horizontal shelf are spaced apart from each other to create a space therebetween.

16. A bed frame having a structural member comprised of a unitary, single piece hollow member having an external shaped metal shell forming an inner, enclosed space and wherein the unitary, single piece hollow member has a lateral cross section forming a generally planar shelf and a planar segment extending from the shelf at approximately a right angle.

17. The bed frame of claim 16 wherein the structural member has a curved outer segment.

18. The bed frame of claim 16 wherein the shelf comprises two planar segments positioned generally parallel to each other and wherein the planar segments of the shelf are spaced apart from each other to create a space therebetween.

19. A bed frame assembly constructed of structural members including a pair of parallel spaced apart side rails and at least one cross member spanning between the side rails, the side rail comprised of a T-shaped metal member comprising a vertical flange having a lower edge and a horizontal flange extending therefrom having an outer edge, the bed frame assembly further having a lighting means located inwardly of the outer edge of the horizontal flange and above the lower edge of the vertical flange.

20. A bed frame assembly as defined in claim 19 wherein the lighting means is a plurality of individual lights.

21. A bed frame assembly as defined in claim 20 wherein the individual lights are light emitting diodes.

22. A bed frame assembly constructed of structural members including a pair of parallel spaced apart side rails and at least one cross member spanning between the side rails, at least one of the structural members comprising a hollow member having an external shaped metal shell forming an inner, enclosed space, the structural member having a lateral cross section forming a generally horizontal shelf and having a vertical segment facing inwardly of the bed frame assembly wherein the assembly has an outer curved segment.

23. The bed frame assembly of claim 22 wherein the at least one structural member has an outer segment having an intermediate vertical portion and upper and lower diagonal portions.

24. The bed frame assembly of claim 22 wherein the at least one structural member has an outer segment extending generally vertically.

25. A structural member for constructing a bed frame wherein the structural member is comprised of a hollow member having an external shaped metal shell forming an inner, enclosed space and wherein the member has a lateral cross section forming a generally planar shelf and a planar segment extending from the shelf at approximately a right angle and wherein the member has a curved outer segment.

* * * * *